US011112106B1

(12) United States Patent
Ding et al.

(10) Patent No.: US 11,112,106 B1
(45) Date of Patent: Sep. 7, 2021

(54) CORDLESS LAMP

(71) Applicant: Shenzhen Zhongfuneng Electric Equipment Co., Ltd., Shenzhen (CN)

(72) Inventors: Baiping Ding, Shenzhen (CN); Feng Yang, Shenzhen (CN); Yangbiao Huang, Shenzhen (CN); Linjing Song, Shenzhen (CN)

(73) Assignee: Shenzhen Zhongfuneng Electric Equipment Co., Ltd., Shenzhen (CN)

( * ) Notice: Subject to any disclaimer, the term of this patent is extended or adjusted under 35 U.S.C. 154(b) by 0 days.

(21) Appl. No.: 17/138,358

(22) Filed: Dec. 30, 2020

(51) Int. Cl.

| | |
|---|---|
| ***F21V 31/00*** | (2006.01) |
| ***F21L 4/00*** | (2006.01) |
| ***F21V 7/06*** | (2006.01) |
| ***F21V 21/088*** | (2006.01) |
| ***F21V 17/16*** | (2006.01) |

(52) U.S. Cl.
CPC ..... *F21V 31/005* (2013.01); *F21V 7/06* (2013.01); *F21V 17/16* (2013.01); *F21V 21/088* (2013.01)

(58) Field of Classification Search
CPC ..... F21V 31/005; F21V 7/06; F21V 17/16; F21V 21/088
See application file for complete search history.

(56) References Cited

U.S. PATENT DOCUMENTS

| | | | | |
|---|---|---|---|---|
| 7,293,898 | B2 * | 11/2007 | Kumthampinij | F21L 4/027 362/184 |
| 7,513,660 | B2 * | 4/2009 | Spartano | F21V 29/15 362/373 |
| 7,674,013 | B2 * | 3/2010 | Leslie | F21V 23/04 362/249.05 |
| 8,449,132 | B2 * | 5/2013 | Lau | F21L 4/00 362/105 |
| 9,488,331 | B2 * | 11/2016 | Sharrah | F21V 17/02 |
| 9,726,356 | B2 * | 8/2017 | Ormsbee | F21L 4/04 |
| 10,401,007 | B1 * | 9/2019 | York | F21V 23/008 |
| 2021/0148543 | A1 * | 5/2021 | Ding | F21V 7/048 |

* cited by examiner

*Primary Examiner* — Arman B Fallahkhair

(57) ABSTRACT

Provided is a cordless lamp including a bottom housing, a cover housing, and a light-emitting module. The bottom housing has an open upper end, which is provided with a clamping groove and a snap ring arranged on an inner wall of the bottom housing. The cover housing has an open lower end, and is interlocked with the bottom housing. The cover housing is provided with a first and a second locking protrusion. The first locking protrusion is snap-fitted with the snap ring so that the open upper end of the bottom housing abuts an open lower end of the cover housing to form a first waterproof structure. The second locking protrusion is fitted with the clamping groove, and an adhesive is filled between the second locking protrusion and the clamping groove to form a second waterproof structure. The light-emitting module is arranged between the bottom housing and the cover housing.

13 Claims, 15 Drawing Sheets

CORDLESS LAMP

TECHNICAL FIELD

The present disclosure relates to the technical field of a lighting device, and more specifically, to a cordless lamp.

BACKGROUND

Existing cordless lamps available on the market cannot provide a satisfactory waterproof performance. Thus, for some special places having high waterproof requirements, such as, in the field or a long-term water operating environment, common cordless lamps will not be able to meet the requirements. As such, the water present in the working environment may easily enter the interior of the cordless lamp, resulting in a short circuit of the storage power supply arranged inside the cordless lamp, which may cause the cordless lamp unable to be normally used, and which may threaten the user's life in some severe cases.

SUMMARY

An object of the present disclosure is to provide a cordless lamp, which has superior waterproof performance and high reliability of use.

To achieve the above technical effect, the present disclosure provides the following solutions.

The present disclosure disclosed a cordless lamp including a bottom housing, a cover housing and a light-emitting module. The bottom housing has an open upper end, and an open upper end of the bottom housing is provided with a clamping groove and a snap ring arranged on an inner wall of the bottom housing. The cover housing has an open lower end, and the cover housing is interlocked with the bottom housing. The cover housing is provided with a first locking protrusion and a second locking protrusion. The first locking protrusion is snap-fitted with the snap ring so that the open upper end of the bottom housing abuts against an open lower end of the cover housing to form a first waterproof structure. The second locking protrusion is fitted with the clamping groove. An adhesive is filled between the second locking protrusion and the clamping groove to form a second waterproof structure. The light-emitting module is arranged between the bottom housing and the cover housing.

In some embodiments, the first locking protrusion is provided with a first inclined surface inclined toward an inner wall of the cover housing in a downward direction. The snap ring is provided with a second inclined surface inclined away from an inner wall of the bottom housing in an upward direction. The first inclined surface and the second inclined surface are correspondingly disposed.

In some embodiment, a sidewall of the second locking protrusion is provided with an inclined protrusion inclined away from the sidewall of the second locking protrusion in a direction from top to bottom. Alternatively, a lower end of the second locking protrusion is provided with a wedge-shaped protrusion whose cross-sectional area gradually increases from top to bottom. Alternatively, a sidewall of the second locking protrusion is provided with a limiting step extending along a length of the second locking protrusion.

In some embodiment, the second locking protrusion is an annular protrusion around the cover housing, and first sawtooth grooves are uniformly arranged on the annular protrusion. The clamping groove is an annular groove arranged around the bottom housing, and the annular groove is provided with an inner groove edge and an outer groove edge. Second sawtooth grooves staggered with the first sawtooth grooves are uniformly arranged on the inner groove edge.

In some embodiment, the cordless lamp further includes a hook module and a friction rotational shaft. The hook module is arranged on a bottom wall of the bottom housing, and the hook module is provided with a mounting lug and a nail hanging hole. One end of the friction rotational shaft is disposed through the mounting lug, and the other end of the friction rotational shaft is connected to the bottom housing. The hook module is capable of rotating relative to the friction rotational shaft, and the friction rotational shaft is configured to maintain the hook module at a position arranged at an included angle with the bottom housing.

In some specific embodiments, the hook module includes a first plate member and a second plate member. The first plate member is provided with two mounting lugs oppositely disposed to each other, and a clearance notch. One end of the second plate member is connected to the first plate member. A projection of the second plate member in a vertical direction coincides with a projection of the first plate member in the vertical direction. The second plate member is provided with the nail hanging hole, and the nail hanging hole is arranged corresponding to the clearance notch.

In some more specific embodiments, the second plate member includes a first inclined plate and a second inclined plate. One end of the first inclined plate is connected to the first plate member through a rounded corner, and the first inclined plate is inclined toward the first plate member along a length of the first plate member. One end of the second inclined plate is connected to the first inclined plate, the second inclined plate is inclined away from the first plate in a direction away from the first inclined plate, and a connecting section of the second inclined plate and the first inclined plate abuts against the first plate.

In some more specific embodiments, the nail hanging hole includes a first elongated hole, a second elongated hole and a third elongated hole. A width of the first elongated hole is greater than a width of the second elongated hole, and the width of the second elongated hole is greater than a width of the third elongated hole. In addition, the second elongated hole is connected to an end of the first elongated hole facing toward a joint of the first plate member and the second plate member, and the third elongated hole is connected to an end of the second elongated hole facing toward a joint of the first plate member and the second plate member.

In some specific embodiments, the friction rotational shaft includes an smooth shaft, a friction piece and a pressing cap. One end of the smooth shaft is provided with a connecting hole, and the smooth shaft is connected to the bottom housing through a connecting member running through the connecting hole. A plurality of friction pieces are provided and the smooth shaft is inserted through the plurality of friction pieces. The pressing cap is connected to the other end of the smooth shaft and used for pressing the friction piece.

In some embodiments, a front side and a rear side of the bottom housing are each provided with a first curved portion. A front side and a rear side of the cover housing are provided with a second curved portion, respectively. The second curved portion is arranged corresponding to the first curved portion. The first curved portion and the second curved portion define an curved battery compartment. A cross section of the curved battery compartment is a partial circle ranging from ½ to ¾ of one circle.

In some embodiments, the cover housing includes a main body and a lamp hood protruding from the main body. The lamp hood has a light outbound surface, and the light outbound surface is arranged at an included angle with a bottom wall of the cover housing.

In some specific embodiments, the light-emitting module includes a reflecting cup and a circuit board. The reflecting cup is arranged in the lamp hood and a top wall of the reflecting cup abuts against the light outbound surface, and a bottom wall of the reflecting cup is provided with a matching hole. The circuit board is arranged on the bottom housing. A light-emitting element fitted with the matching hole is arranged on the circuit board.

In some more specific embodiments, the circuit board is provided with a mounting hole, and the reflecting cup is provided with a mounting protrusion fitted with the mounting hole.

In the cordless lamp according to the present disclosure, the first locking protrusion is snap-fitted with the snap ring so that the open upper end of the bottom housing abuts against the open lower end of the cover housing to form a first waterproof structure, and an adhesive is filled between the second locking protrusion and the clamping groove to form the second waterproof structure. Thus, there are formed two waterproof structures between the bottom housing and the cover housing of the cordless lamp, thereby improving the waterproof performance of the cordless lamp and the reliability of use of the corresponding high-bay light.

Additional aspects and advantages of the present disclosure will be partially set forth in the following description, and will become apparent from the following description, or may be learned through practice of the present disclosure.

BRIEF DESCRIPTION OF DRAWINGS

FIG. 1.

REFERENCE SIGNS

Figure 1:
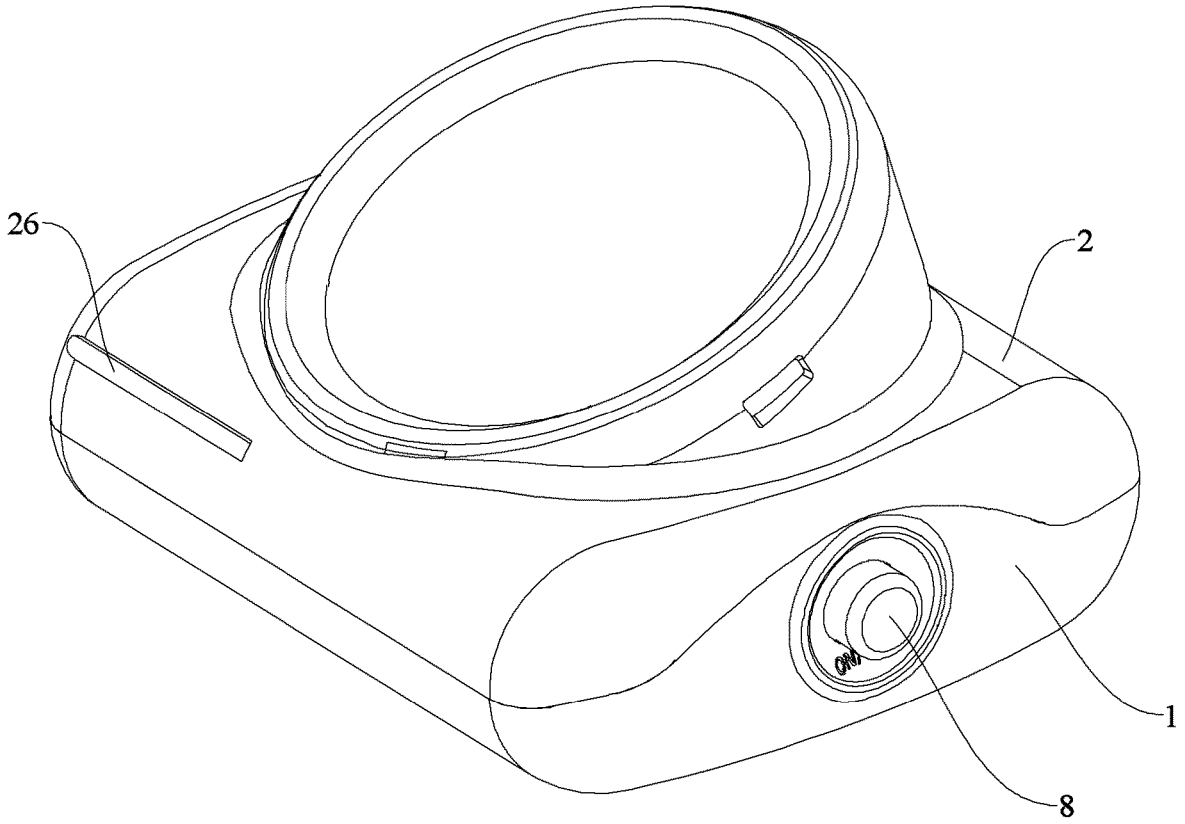
FIG. 1 is a schematic view illustrating a cordless lamp of an embodiment of the present disclosure.

| | | | |
|---|---|---|---|
| 1. | bottom housing | 11. | snap groove |
| 111. | inner groove edge | 1111. | second sawtooth groove |
| 112. | outer groove edge | 12. | snap ring |
| 121. | second inclined surface | 13. | reinforcing rib |
| 14. | first curved portion | 15. | first sliding groove |
| 16. | supporting bump | 101. | curved battery compartment |
| 2. | cover housing | 21. | first locking protrusion |
| 211. | first inclined surface | 22. | second locking protrusion |
| 221. | inclined protrusion | 222. | wedge-shaped protrusion |
| 223. | limiting step | 224. | first sawtooth groove |
| 23. | second curved portion | 24. | main body |
| 25. | lamp hood | 251. | light outbound surface |
| 26. | second sliding groove | 3. | light-emitting module |
| 31. | reflecting cup | 311. | mounting protrusion |
| 3111. | reinforcing structure | 32. | circuit board |
| 321. | mounting hole | 322. | welding hole |
| 33. | light-emitting element | 331. | main light source |
| 332. | secondary light source | 34. | reflecting element |
| 341. | hollow structure | 4. | hook module |
| 41. | first plate member | 411. | mounting lug |
| 412. | clearance notch | 42. | second plate member |
| 421. | first inclined plate | 422. | second inclined plate |

-continued

| | |
|---|---|
| 401. nail hanging hole | 4011. first elongated hole |
| 4012. second elongated hole | 4013. third elongated hole |
| 4014. closed hole | 43. third plate member |
| 431. assembly lug | 5. friction rotational shaft |
| 51. smooth shaft | 52. friction piece |
| 53. pressing cap | 6. charge/discharge port |
| 61. interface area | 611. guide groove |
| 612. limit groove | 62. charge/discharge contact point |
| 7. switch | 8. button assembly |
| 81. key | 811. flexible member |
| 8111. body | 8112. protruding ring |
| 812. rigid member | 82. protective cover |
| 83. mounting plate | 9. power source |

DETAILED DESCRIPTION

For a better understanding of the problems to be solved, solutions adopted, and effects to be achieved by the present disclosure, solutions according to the present disclosure will now be described below by way of embodiments in connection with the accompanying drawings.

As used herein, terms "center", "longitudinal", "lateral", "length", "width", "thickness", "above", "below", "front", "back", "left", "right", "vertical", "horizontal", "top", "bottom", "inside", "outside", "clockwise", "counterclockwise", "axial", "radial", "circumferential", etc. indicate orientational or positional relationships that are based on the orientational or positional relationships illustrated in the drawings. They are intended for the mere purpose of facilitating and simplifying the description of the present disclosure, and do not indicate or imply that the device or element referred to has a specific orientation or is constructed and operated in a specific orientation. Thus, they are not to be construed as limiting the present disclosure.

In addition, a feature defined as a "first feature" or a "second feature" may explicitly or implicitly include one or more of such features. These terms are intended for mere purposes of distinguishing the features under description one from another, and do not imply order or relative importance. In the description of the present disclosure, unless otherwise specified, the phrase "a plurality of" means two or more.

In the description of the present disclosure, it is to be noted that unless otherwise expressly specified and defined, the term "mounted", "connected to each other" or "connected" should be construed in a broad sense as securely connected, detachably connected or integrally connected; mechanically connected or electrically connected; directly connected to each other or indirectly connected to each other via an intermediary; or intraconnected between two components. For those of ordinary skill in the art, specific meanings of the preceding terms in the present disclosure may be construed based on specific situations.

A specific structure of a cordless lamp of an embodiment of the present disclosure is described below with reference to FIGS. 1 to 15.

As illustrated in FIGS. 1 to 4, the cordless lamp of the present embodiment includes a bottom housing 1, a cover housing 2 and a light-emitting module 3. The bottom housing 1 has an open upper end, and an open upper end of the bottom housing 1 is provided with a clamping groove 11 and a snap ring 12 arranged on an inner wall of the bottom housing 1. The cover housing has an open lower end, and the cover housing 2 is interlocked with the bottom housing 1. The cover housing 2 is provided with a first locking protrusion 21 and a second locking protrusion 22. The first locking protrusion 21 is snap-fitted with the snap ring 12 so that the open upper end of the bottom housing 1 abuts against an open lower end of the cover housing 2 to form a first waterproof structure. The second locking protrusion 22 is fitted with the clamping groove 11. An adhesive is filled between the second locking protrusion 22 and the clamping groove 11 to form a second waterproof structure. The light-emitting module 3 is arranged between the bottom housing 1 and the cover housing 2.

It is to be understood that for the cordless lamp of the present embodiment, the first locking protrusion 21 is snap-fitted with the snap ring 12 so that the open upper end of the bottom housing 1 abuts against the open lower end of the cover housing 2 to form the first waterproof structure, and the adhesive is filled between the second locking protrusion 22 and the clamping groove 11 to form the second waterproof structure. In other words, two waterproof structures are formed between the bottom housing 1 and the cover housing 2 of the cordless lamp in the present embodiment, thereby better improving waterproof performance of the cordless lamp and the reliability of use of the corresponding high-bay light and the like.

It should be added that in the present embodiment, the bottom housing 1 and the cover housing 2 are made of polytetrafluoroethylene, and the adhesive is polyurethane adhesive or other low-temperature quick-drying adhesive. Typically, the bottom housing 1 and the cover housing 2 are made of transparent plastic material and have a thickness of more than 1.5 mm, so that the bottom housing 1 and the cover housing 2 have good support and impact resistance, thereby having a longer service life. Certainly, in other embodiments of the present disclosure, the material of the bottom housing 1 and the cover housing 2 and a type of the adhesive can be selected according to actual needs and are not limited to the above description.

It should be further added that when assembling the cordless lamp of the present embodiment, firstly, it is necessary to place an appropriate amount of adhesive in the clamping groove 11, and the amount of the adhesive ranges from ⅕ to ⅓ of a depth of the clamping groove 11. Secondly, it is necessary to ensure that the first locking protrusion 21 is aligned with the snap ring 12, the second locking protrusion 22 of the cover housing 2 is inserted into the clamping groove 11, and the first locking protrusion 21 is snap-fitted with the snap ring 12. Finally, the adhesive is cured to realize adhesion between the bottom housing 1 and the cover housing 2. In order to ensure adhesion strength between the bottom housing 1 and the cover housing 2, curing may be performed twice or more times. Further, the curing may be normal temperature curing or ultraviolet curing. A specific curing type may be selected according to a type of the adhesive, and is not limited to the aforementioned normal temperature curing and ultraviolet curing.

Figure 2:
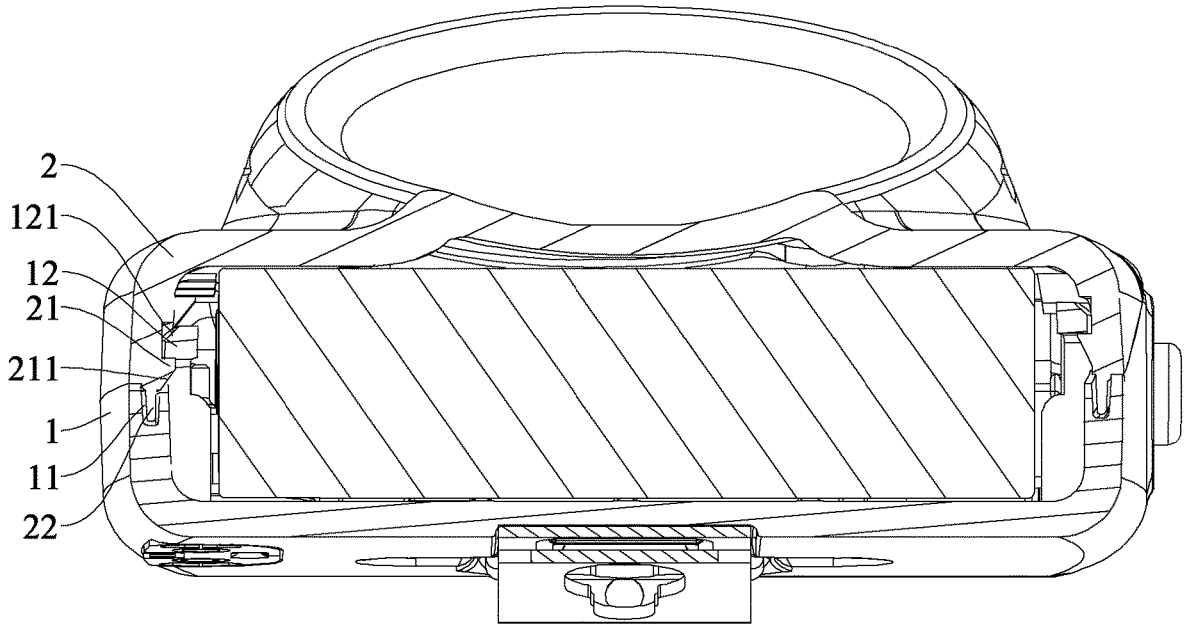
FIG. 2 is a sectional view of the cordless lamp illustrated in FIG. 1 from an angle.

In some embodiments, as illustrated in FIG. 2, the first locking protrusion 21 is provided with a first inclined surface 211 inclined toward an inner wall of the cover housing 2 in a downward direction. The snap ring 12 is provided with a second inclined surface 121 inclined away from an inner wall of the bottom housing 1 in an upward direction. It can be understood that during an actual mounting process, in a process of inserting the second locking protrusion 22 of the cover housing 2 into the clamping groove 11, the first locking protrusion 21 needs to be moved from a position where the first locking protrusion 21 is snap-fitted with an upper end surface of the snap ring 12 to a position where the first locking protrusion 21 is snap-fitted with a lower cross section of the snap ring 12. Arrangement of the first inclined surface 211 and the second inclined surface 121 is capable of conveniently realizing movement of the first locking protrusion 21 relative to the snap ring 12, so that the first locking protrusion 21 can be more smoothly snap-fitted with the snap ring 12.

In some specific embodiments, a plurality of first locking protrusions 21 are spaced apart along a circumferential direction of the cover housing 2 and a plurality of snap rings 12 are spaced apart along an axial direction of the bottom housing 1. Therefore, engagement of the plurality of first locking protrusions 21 and the plurality of snap rings 12 can ensure connection stability and the connection sealing performance of the cover housing 2 and the bottom housing 1, thereby ensuring the reliability of the whole cordless lamp.

In some embodiments, the snap groove 11 is an annular groove provided around an open upper end of the bottom housing 1, and the second locking protrusion 22 is formed as an annular protrusion around the cover housing 2. Therefore, a contact area between the second locking protrusion 22 and the clamping groove 11 is increased, thereby ensuring the connection stability and the connection sealing performance of the bottom housing 1 and the cover housing 2. Advantageously, the annular groove is located in a middle portion of a top wall of the bottom housing 1, and the second locking protrusion 22 is formed in a middle portion of a bottom wall of the cover housing 2. Thus, the connection stability and the connection sealing performance of the bottom housing 1 and the cover housing 2 are further ensured.

In some specific embodiments, a bottom wall of the clamping groove 11 is provided with a groove structure, and a lower end of the second locking protrusion 22 is provided with a protruding structure mated with the groove structure. It can be understood that engagement of the groove structure and the protruding structure is capable of limiting shaking of the second locking protrusion 22 in the clamping groove 11, which improves connection stability of the second locking protrusion 22 and the clamping groove 11, thereby further ensuring the connection stability and the connection sealing performance of the bottom housing 1 and the cover housing 2.

Figure 13:
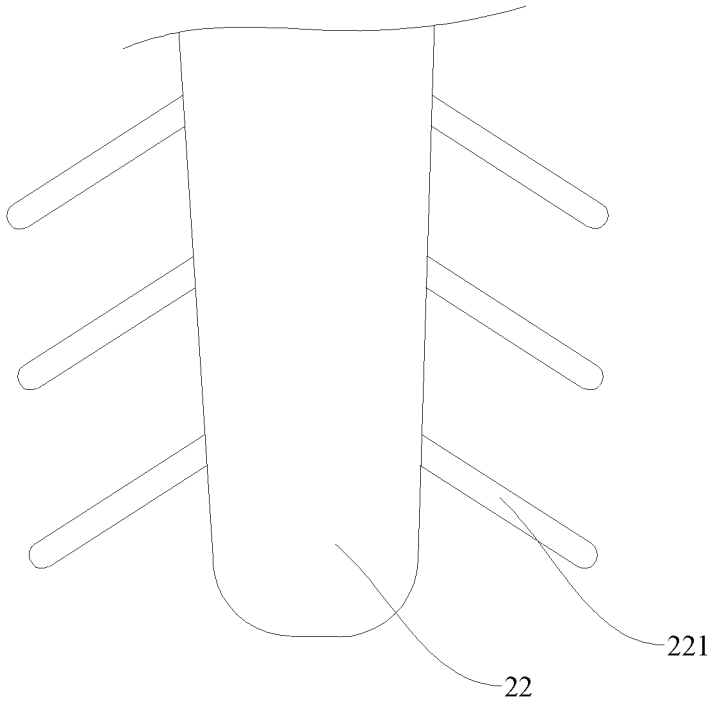
FIG. 13 is a schematic view illustrating a second locking protrusion of a cover housing of the cordless lamp of another embodiment of the present disclosure.

In some specific embodiments, as illustrated in FIG. 13, the second locking protrusion 22 is provided with an inclined protrusion 221 inclined away from the sidewall of the second locking protrusion 22 in a direction from top to bottom. It can be understood that when the second locking protrusion 22 is disposed in the clamping groove 11, liquid adhesive is capable of completely wrapping each part of a main body 24 of the second locking protrusion 22 and the inclined protrusion 221. The inclined protrusion 221 is capable of increasing a contact area between the second locking protrusion 22 and the adhesive, which effectively improves an adhesive force between the second locking protrusion 22 and the adhesive, thereby ensuring the connection stability and connection sealing performance of the cover housing 2 and the bottom housing 1. In addition, the incline protrusion 221 is inclined away from the second locking protrusion 22 in a direction away from top to bottom, so that the adhesive between the incline protrusion 221 and the main body 24 of the second locking protrusion 22 is capable of effectively preventing the second locking protrusion 22 from being detached from an adhesive portion, thereby ensuring close adhesion between the bottom housing 1 and the cover housing 2.

Figure 14:
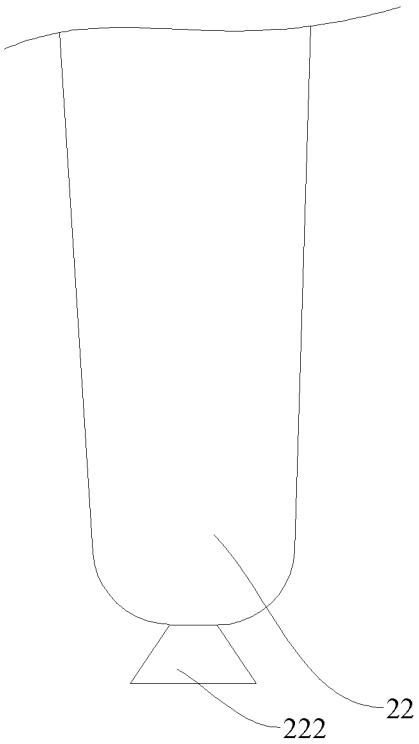
FIG. 14 is a schematic view illustrating a second locking protrusion of a cover housing of the cordless lamp of yet another embodiment of the present disclosure.
Figure 15:
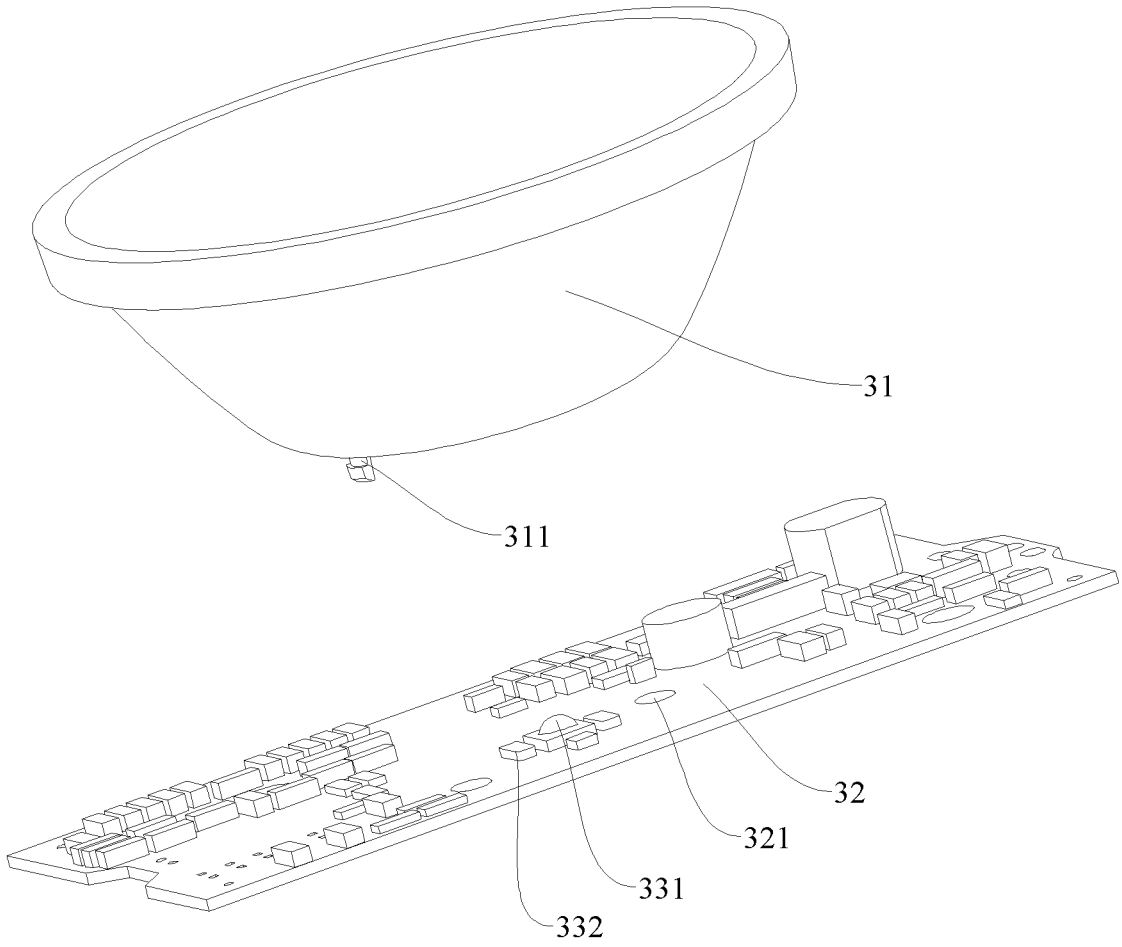
FIG. 15 is a schematic view illustrating a mating structure between the circuit board and a reflecting cup of the cordless lamp of another embodiment of the present disclosure.
Figure 16:
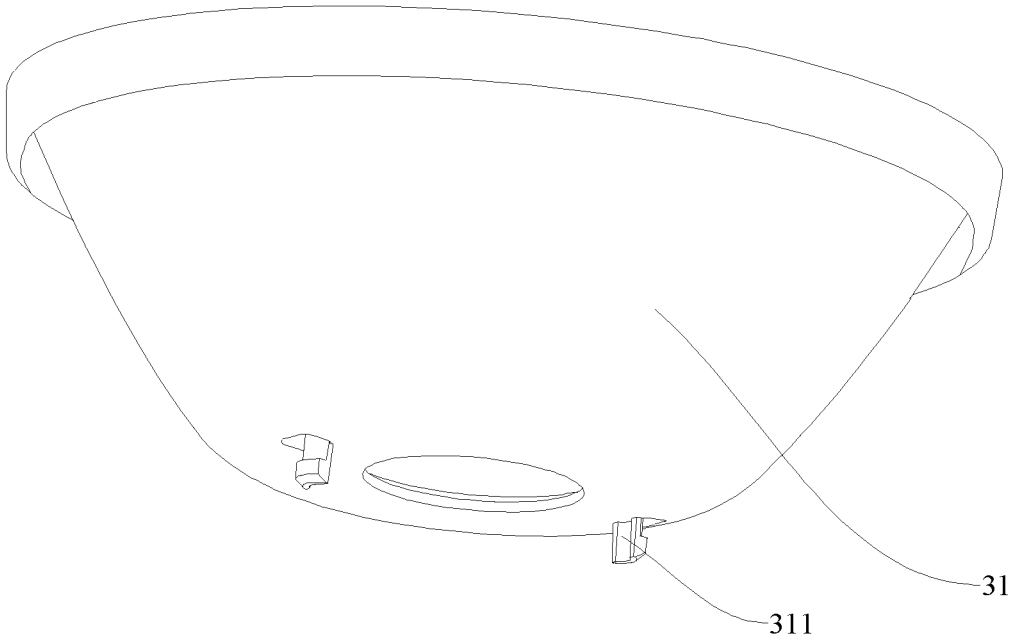
FIG. 16 is a schematic view illustrating the reflecting cup illustrated in FIG. 15.
Figure 17:
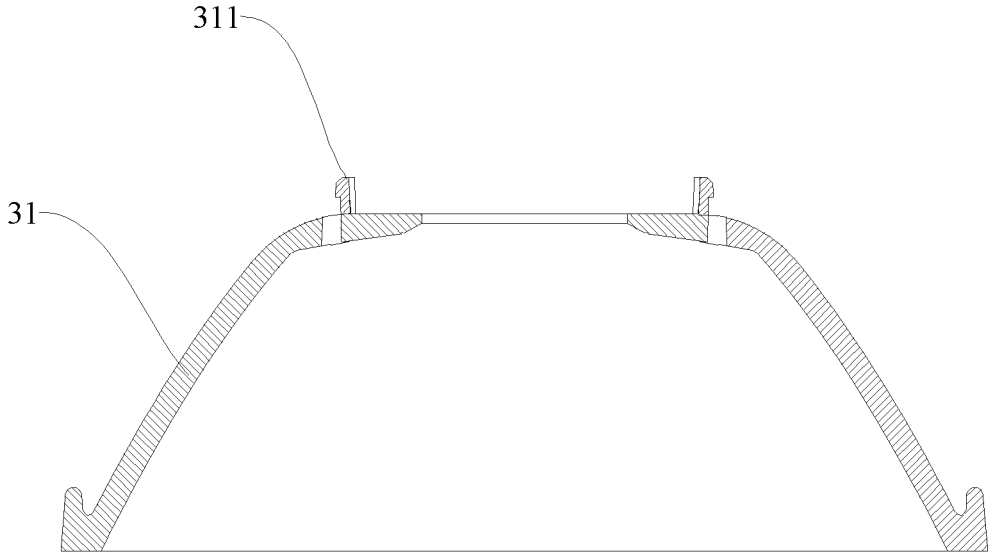
FIG. 17 is a sectional view illustrating the reflecting cup illustrated in FIG. 15.

In some specific embodiments, as illustrated in FIG. 14, the lower end of the second locking protrusion 22 is provided with a wedge-shaped protrusion 222 whose cross-sectional area gradually increases from top to bottom. It is to be understood that the additional wedge-shaped protrusion 222 is capable of increasing an adhesive contact area between the second locking protrusion 22 and the adhesive. A cross-sectional area of the wedge-shaped protrusion 222 gradually increases in a direction away from the second locking protrusion 22. The adhesive between the wedge-shaped protrusion 222 and the second locking protrusion 22 is capable of effectively preventing the second locking protrusion 22 from being detached from the adhesive portion, thereby ensuring close adhesion between the bottom housing 1 and the cover housing 2.

Figure 11:
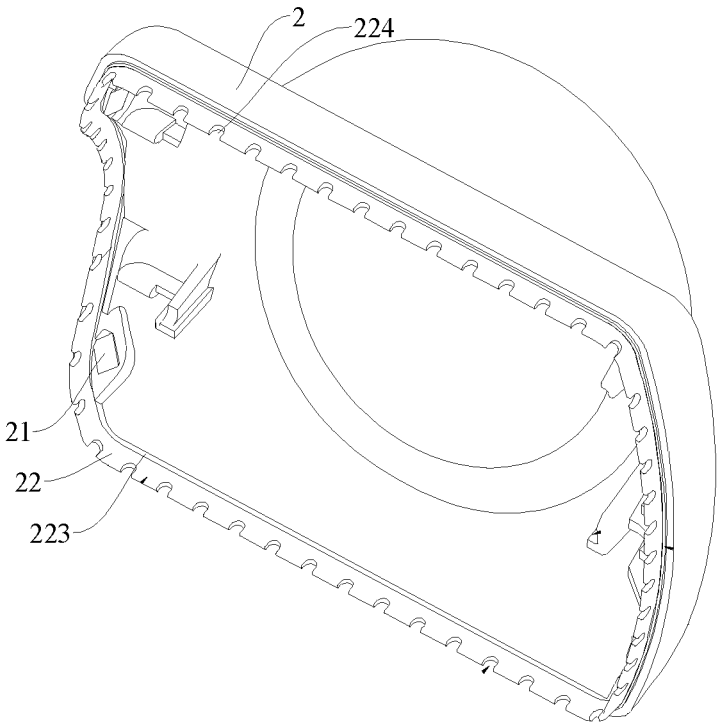
FIG. 11 is a schematic view illustrating a cover housing of the cordless lamp of another embodiment of the present disclosure.
Figure 12:
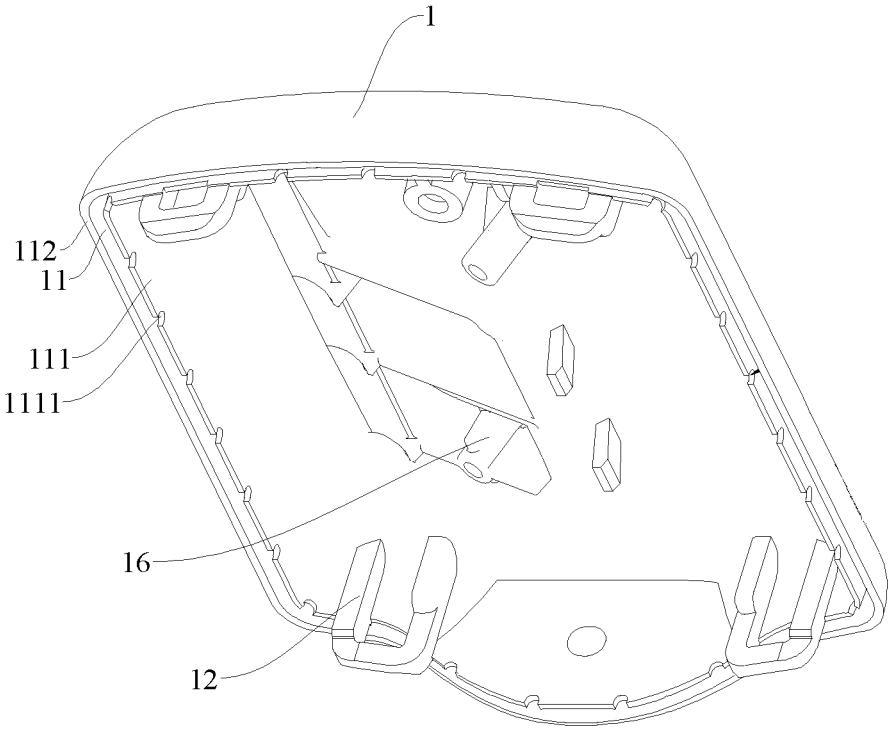
FIG. 12 is a schematic view illustrating a structure of the bottom housing mated with the cover housing illustrated in FIG. 11.

In some specific embodiments, as illustrated in FIG. 11, two oppositely disposed sidewalls of the second locking protrusion 22 each are provided with a limiting step 223 extending along a length of the second locking protrusion 22, and a height of the limiting step 223 is lower than that of the second locking protrusion 22. It can be understood that when the second locking protrusion 22 is inserted into the clamping groove 11, the limiting steps 223 on two sides are abutted against two oppositely disposed sidewalls of the clamping groove 11, respectively, which further increases an adhesive sealing contact surface between the bottom housing 1 and the cover housing 2, thereby increasing sealing adhesive strength.

In some specific embodiments, as illustrated in FIG. 11, the second locking protrusion 22 is uniformly provided with first sawtooth grooves 224. The clamping groove 11 is provided with an inner groove edge 111 and an outer groove edge 112. The inner groove edge 111 is uniformly provided with second sawtooth grooves 1111 staggered with the first sawtooth grooves 224.

It can be understood that, when the adhesive glue is pour into the clamping groove 11, if bubbles are present in the adhesive, the first sawtooth grooves 224 and the second sawtooth grooves 1111 that are staggered with each other are capable of eliminating bubbles in a gap between the second locking protrusion 22 and the clamping groove 11, thereby avoiding generation of bubbles during the process of applying the adhesive. Even if there are bubbles, large bubbles can be divided into smaller bubbles through the sawtooth-like structure, which avoids presence of large bubbles in adhesive seams, thereby ensuring the connection sealing performance of the bottom housing 1 and the cover housing 2, so that a structure between the bottom housing 1 and the cover housing 2 is more firm and reliable.

It should be added that when the adhesive glue is poured, a height of the adhesive is flush with a root of the second sawtooth groove 1111. Therefore, overflow of the adhesive is avoided, thereby avoiding a process for a user to clean overflow adhesive and facilitating assembly of the bottom housing 1 and the cover housing 2.

Typically, a tooth spacing between each of the adjacent first sawtooth grooves 224 and the second sawtooth grooves 1111 is L, and a staggered distance between each of the adjacent first sawtooth groove 224 and the second sawtooth groove 1111 is L/2 when the bottom housing 1 and the cover housing 2 are mated. It can be understood that the first sawtooth grooves 224 and the second sawtooth grooves 1111 have a same sawtooth groove spacing, and the staggered distance is L/2, so that staggered arrangement of the first sawtooth groove 224 and the second sawtooth groove 1111 is more regular, which can better decompose the large bubbles in the adhesive into smaller bubbles, and further eliminate the smaller bubbles, thereby ensuring the connection sealing performance of the bottom housing 1 and the cover housing 2, so that the structure between the bottom housing 1 and the cover housing 2 is more firm and reliable.

Typically, the second locking protrusion 22 is further uniformly provided with a third sawtooth groove with a tooth spacing L. Sawtooth grooves of the third sawtooth grooves and the first sawtooth grooves 224 are arranged at intervals. Positions of the third sawtooth grooves and the second sawtooth grooves 1111 are disposed directly opposite in one-to-one correspondence when the bottom housing 1 and the cover housing 2 are mated. It can be understood that the third sawtooth grooves each are arranged at intervals between two adjacent first sawtooth grooves 224, and a spacing distance between each of the third sawtooth groove and the sawtooth groove of the first sawtooth groove 224 is L/2. A total number of sawtooth grooves provided on the cover housing 2 is twice a number of sawtooth grooves on the bottom housing 1, and a number of sawtooth grooves on the bottom housing 1 is less than a number of sawtooth grooves on the cover housing 2, thereby preventing glue leakage caused by too many sawtooth grooves on the bottom housing 1 and affecting a glue curing effect.

Typically, bottoms of the first sawtooth groove 224, the second sawtooth groove 1111, and the third sawtooth groove of the present disclosure are arc-shaped. Therefore, formation of sharp angle at the bottom of the sawtooth groove can be avoided, which is beneficial to eliminating bubbles.

Typically, a height of the outer groove edge 112 is higher than a height of the inner groove edge 111. In this way, the poured adhesive glue can be prevented from overflowing, thereby solving a problem that it is difficult to clean up residual adhesive caused by overflow of the adhesive.

Typically, a groove depth of the second sawtooth groove 1111 is half a groove depth of the clamping groove 11. It can be understood that for the sake of smooth glue pouring, the groove depth of the second sawtooth groove 1111 cannot be too deep, otherwise, the adhesive is easy to overflow, nor can the groove depth of the second sawtooth groove 1111 be too shallow, otherwise, in a case where there are bubbles at a relative bottom of the clamping groove 11, the second locking protrusion 22 of the cover housing 2 cannot play a role of using a sawtooth to cut bubbles for bubble dissipation. Therefore, according to an actual size of a groove width, the depth of the second sawtooth groove 1111 is designed to be half of the groove depth of the clamping groove 11, which can better correspond to the first sawtooth groove 224 on the second locking protrusion 22, thereby realizing defoaming. According to sizes of bubbles normally generated in an actual process of pouring the adhesive, the present disclosure designs that a groove width of each sawtooth groove of the first sawtooth groove 224, the second sawtooth groove 1111 and the third sawtooth groove ranges from 1 mm to 3 mm, and a value range of L/2 ranges from 1 mm to 5 mm.

In some specific embodiments, a thickness of the second locking protrusion 22 ranges from 1 mm to 5 mm. A width of the clamping groove 11 ranges from 1.1 mm to 5.1 mm. The width of the clamping groove 11 is greater than the thickness of the second locking protrusion 22, and a difference value between the two ranges from 0.1 mm to 0.5 mm. It can be understood that in the present embodiment, the adhesive is filled between the second locking protrusion 22 and the clamping groove 11 to form the second waterproof structure, so that the width of the clamping groove 11 is greater than the thickness of the second locking protrusion 22. When the difference value is relatively small, it is inconvenient to pour the adhesive into a gap between the clamping groove 11 and the second locking protrusion 22, while when the difference value is relatively great, an adhesive gap is easily caused, thereby affecting the waterproof effect of the second waterproof structure. At the same time, excessive small the thickness of the second locking protrusion 22 will result in a relatively low strength of the second locking protrusion 22, thereby increasing a damage rate of the second locking protrusion 22. While excessive great the thickness of the second locking protrusion 22 will increase a weight of the whole cover housing 2, which is not conducive to a lightweight design of the cordless lamp. Excessive small the width of the clamping groove 11 will lead to processing difficulties, while excessive great the width of the clamping groove 11 will increase a volume of the whole bottom housing 1, which is not conducive to a miniaturization design of the cordless lamp. In the present embodiment, the thickness of the second locking protrusion 22 is controlled between 1 mm and 1.5 mm, and the width of the clamping groove 11 is controlled between 1.1 mm and 5.1 mm. The difference value between the width of the clamping groove 11 and the thickness of the second locking protrusion 22 is controlled between 0.1 mm and 0.5 mm, so that the connection stability and sealing performance of the bottom housing 1 and the cover housing 2 can be better ensured, and the strength of the second locking protrusion 22 can be further ensured. The volume and weight of the bottom housing 1 and the cover housing 2 are limited, which is beneficial to the lightweight and miniaturization design of the cordless lamp.

Typically, the width of the clamping groove 11 ranges from 3.2 mm to 4.2 mm, and the thickness of the second locking protrusion 22 ranges from 3 mm to 4 mm. The difference value between the width of the clamping groove 11 and the thickness of the second locking protrusion 22 ranges from 0.2 mm to 0.4 mm. Certainly, in other embodiments of the present disclosure, the width of the clamping groove 11, the thickness of the second locking protrusion 22, and the difference value between the width of the clamping groove 11 and the thickness of the second locking protrusion 22 can be selected according to actual needs, and are not limited to the above-mentioned limitations.

In some specific embodiments, the height of the second locking protrusion 22 ranges from 5 mm to 10 mm, the depth of the clamping groove 11 ranges from 5.1 mm to 10.1 mm, and the difference value between the depth of the clamping groove 11 and the height of the second locking protrusion 22 ranges from 0.1 mm to 0.5 mm.

Typically, the depth of the clamping groove 11 ranges from 6.2 mm to 8.2 mm, and the height of the second locking protrusion 22 ranges from 6 mm to 8 mm. The difference value between the depth of the clamping groove 11 and the height of the second locking protrusion 22 ranges from 0.2 mm to 0.4 mm. Certainly, in other embodiments of the present disclosure, the depth of the clamping groove 11, the height of the second locking protrusion 22, and the difference value between the depth of the clamping groove 11 and the height of the second locking protrusion 22 can be selected according to actual needs, and are not limited to the above-mentioned limitations.

Figure 9:
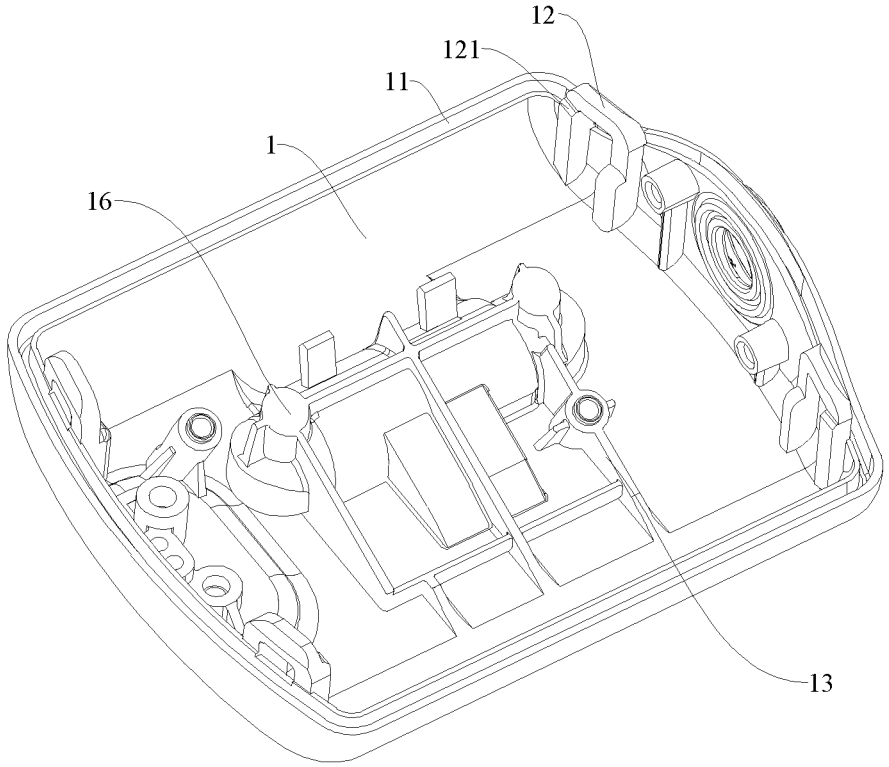
FIG. 9 is a schematic view illustrating a bottom housing of the cordless lamp illustrated in FIG. 1.

In some embodiments, as illustrated in FIG. 9, a sidewall and a bottom wall of the bottom housing 1 are provided with a plurality of reinforcing ribs 13. Therefore, the bottom housing 1 is capable of bearing a relatively large impact force from the outside, and normal use of the whole cordless lamp in a field or water working environment can be ensured.

Figure 6:
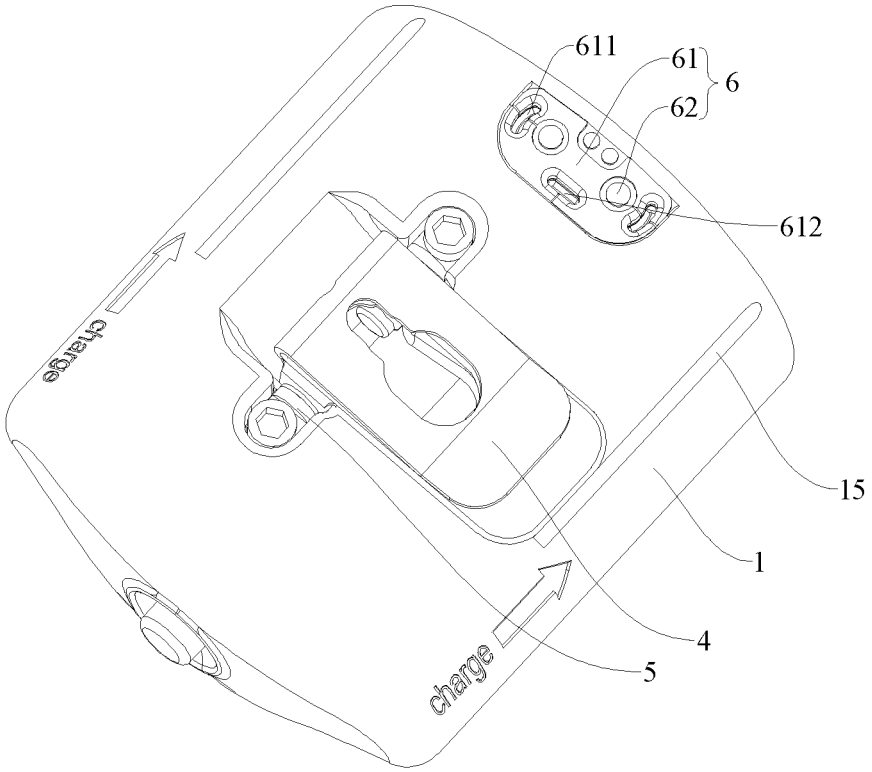
FIG. 6 is a schematic view illustrating a bottom portion of the cordless lamp illustrated in FIG. 1.
Figure 7:
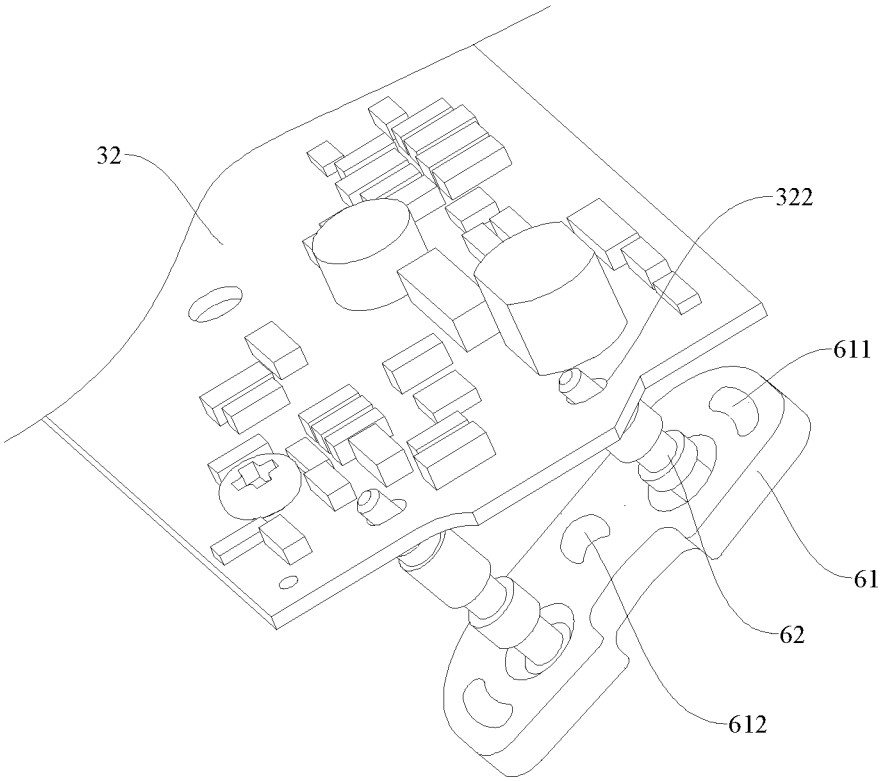
FIG. 7 is a partial schematic view illustrating a charge/discharge port of the cordless lamp illustrated in FIG. 1.
Figure 8:
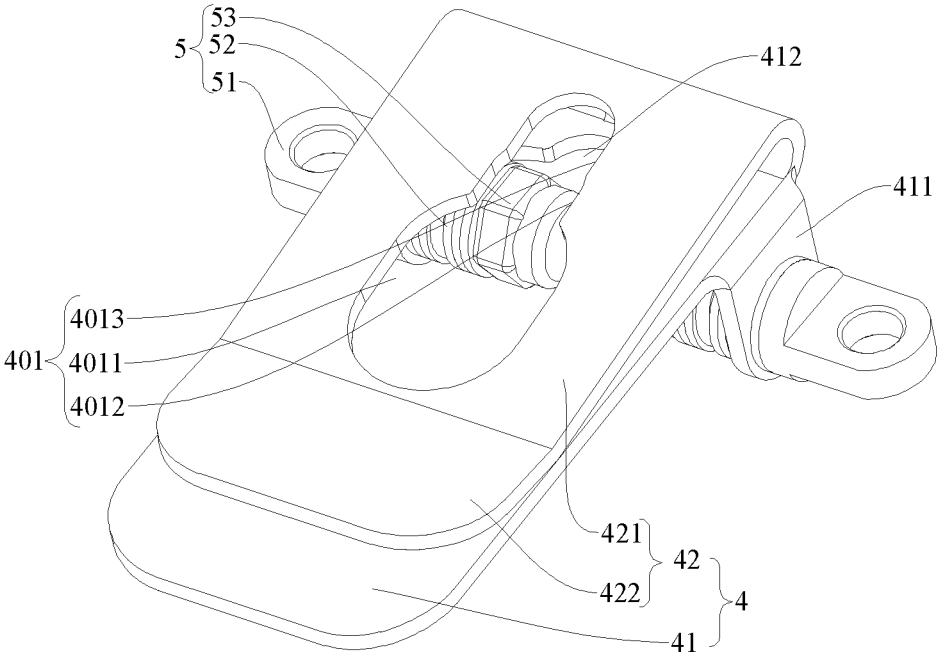
FIG. 8 is a schematic view illustrating a hook module and a friction rotational shaft of the cordless lamp illustrated in FIG. 1.

In some embodiments, as illustrated in FIGS. 6 to 8, the cordless lamp further includes a hook module 4 and a friction rotational shaft 5. The hook module 4 is disposed on the bottom wall of the bottom housing 1 and provided with a mounting lug 411 and a nail hanging hole 401. One end of the friction rotational shaft 5 is arranged through the mounting lug 411, and the other end is connected to the bottom housing 1. The hook module 4 is capable of rotating relative to the friction rotational shaft 5, and the friction rotational shaft 5 is configured to maintain the hook module 4 at a position arranged at an included angle with the bottom housing 1.

First of all, it should be noted that the existing hook module 4 is usually directly fixed and mounted on the bottom housing 1 of the cordless lamp, so that a relative position between the cordless lamp and the hook module 4 is fixed. However, in a practical application of the cordless lamp, the cordless lamps are sometimes required to illuminate at different angles. As the relative position of cordless lamp and hook module 4 are fixed and cannot rotate, an illuminating angle of the cordless lamp cannot be changed, which limits application scenarios of the cordless lamp.

In the present embodiment, the hook module 4 is connected to the bottom housing 1 through the friction rotational shaft 5. The hook module 4 is capable of rotating relative to the friction rotational shaft 5, and the friction rotational shaft 5 is configured to maintain the hook module 4 at a position arranged at an included angle with the bottom housing 1. That is to say, in an actual use process, the hook module 4 is capable of rotating relative to the bottom housing 1, so that the illuminating angle of the cordless lamp can be arbitrarily changed, thereby expanding the application range of the cordless lamp. In addition, since the hook module 4 is capable of rotating relative to the bottom housing 1, in the actual practical process, the hook module 4 can also be used as a bracket for the cordless lamp, which is quite convenient.

Typically, a rotating angle of the hook module 4 can be adjusted to 50°.

In some specific embodiments, as illustrated in FIG. 8, the hook module 4 includes a first plate member 41 and a second plate member 42. The first plate member 41 is provided with two mounting lugs 411 oppositely disposed to each other, and an clearance notch 412. One end of the second plate member 42 is connected to the first plate member 41, and a projection of the second plate member 42 in a vertical direction coincides with a projection of the first plate member 41 in a vertical direction. The second plate member 42 is provided with a nail hanging hole 401, and the nail hanging hole 401 is provided corresponding to the clearance notch 412. It can be understood that projections of the first plate member 41 and the second plate member 42 in the vertical direction coincide, the first plate member 41 and the second plate member 42 are oppositely arranged to each other, so that strength of the hook module 4 can be improved to prevent the hook module 4 from being broken, and space between the first plate member 41 and the second plate member 42 can hide a top cap of the hanging nail, thereby avoiding potential safety hazard caused by protrusion of the top cap.

In some more specific embodiments, as illustrated in FIG. 8, the second plate member 42 includes a first inclined plate 421 and a second inclined plate 422. One end of the first inclined plate 421 is connected to the first plate member 41 through a rounded corner, and the first inclined plate 421 is inclined toward the first plate member 41 along a length of the first plate member 41. One end of the second inclined plate 422 is connected to the first inclined plate 421. The second inclined plate 422 is inclined away from the first plate member 41 in a direction away from the first inclined plate 421, and a connecting section of the second inclined plate 422 and the first inclined plate 421 abuts against the first plate member 41. It can be understood that the second plate member 42 is formed as a duck tongue mechanism forming of the first inclined plate 421 and the second inclined plate 422. Such duck tongue structure enables the user to easily hang a hanging portion into an upper position between the first plate member 41 and the second plate member 42 of the hook module 4 through the duck tongue structure when using the hook module 4. In addition, the hanging portion is capable of tightly pressing against a bending portion (i.e., a connecting member of the first plate member 41 and the second plate member 42) of the duck tongue structure without moving, thereby ensuring use reliability of the hook module 4.

Typically, the first plate member 41 and the second plate member 42 are formed by bending an integral plate. At an upper portion, the first plate member 41 and the second plate member 42 are bent and formed with a distance of about 2 mm. A size of the main body 24 of the second plate member 42 is 33 mm×20 mm. A thickness of the second plate member 42 is the same as that of the first plate member 41 and is 1 mm. The duck tongue structure is formed at a lower portion of the second plate member 42 about 10 mm from a bottom edge. The lower bottom edge of the second plate member 42 is about 2 mm away from the first plate member 41.

In some specific embodiments, as illustrated in FIG. 8, the nail hanging hole 401 includes a first elongated hole 4011, a second elongated hole 4012 and a third elongated hole 4013. A width of the first elongated hole 4011 is greater than a width of the second elongated hole 4012, and the width of the second elongated hole 4012 is greater than a width of the third elongated hole 4013. In addition, the second elongated hole 4012 is connected to an end of the first elongated hole 4011 facing toward a joint of the first plate member 41 and the second plate member 42, and the third elongated hole 4013 is connected to an end of the second elongated hole 4012 facing toward a joint of the first plate member 41 and the second plate member 42. It can be understood that during a nail hanging process, the first elongated hole 4011 is relatively wide, which facilitates extending the nail cap into the nail hanging hole 401, while the second elongated hole 4012 and the third elongated hole 4013 are relatively narrow to restrict the nail cap from sliding out of the nail hanging hole 401 on a premise that a nail body is capable of passing through, which ensures that the hanging nail can be stably maintained in the nail hanging hole 401, thereby ensuring the nail hanging stability of the cordless lamp.

Typically, a first elongated hole 4011 of 12.5×9.5 mm is laterally centered about 10 mm away from the bottom edge of the second plate member 42, and a second elongated hole 4012 with a width of 5.3 mm and a third elongated hole 4013 with a width of 4.2 mm are sequentially connected to the first elongated hole 4011, where the second elongated hole 4012 is about 11 mm and the third elongated hole 4013 is about 6 mm away from a top portion of the second plate member 42. The first elongated hole 4011 and the second elongated hole 4012 are transitioned by an edge fillet. The second elongated hole 4012 and the third elongated hole 4013 are transitioned by an edge fillet. A top portion of the third elongated hole 4013 has a semi-circular arc structure with a diameter of 4.2 mm. The structure of the nail hanging hole 401 of the present embodiment may be applied to hanging nails with diameters of 5.0 mm and 4.0 mm, respectively, or different nail hanging holes 401 may be set according to different nail-hanging sizes.

In some specific embodiments, as illustrated in FIG. 8, the friction rotational shaft 5 includes an smooth shaft 51, a friction piece 52, and a pressing cap 53. One end of the smooth shaft 51 is provided with the connecting hole. The smooth shaft 51 is connected to the bottom housing 1 through the connecting member arranged through the connecting hole. A plurality of the friction pieces 52 are provided and arranged through the smooth shaft 51. The pressing cap 53 is connected to the other end of the smooth shaft 51 and used for pressing the friction piece 52. It can be understood that the smooth shaft 51 ensures that the friction rotational shaft 5 can be stably connected to the bottom housing 1 and that the hook module 4 is capable of rotating stably relative to the bottom housing 1, while the friction piece 52 ensures that the hook module 4 is maintained at a position arranged at an included angle with the bottom housing 1 when rotating at a certain angle relative to the bottom housing 1, In some embodiments, the hook module 4 and the friction rotational shaft 5 are made of stainless steel, so that the hook module 4 and the friction rotational shaft 5 possess strong corrosion resistance and can be used under very complicated and harsh conditions.

Figure 28:
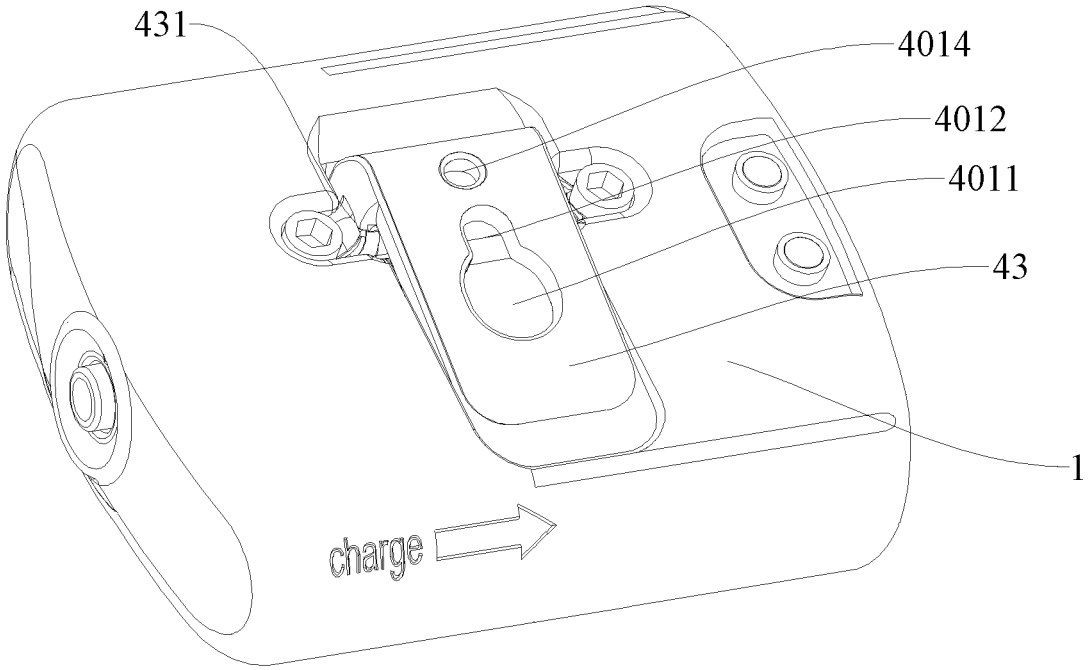
FIG. 28 is a schematic view illustrating a cordless lamp of another embodiment of the present disclosure.
Figure 29:
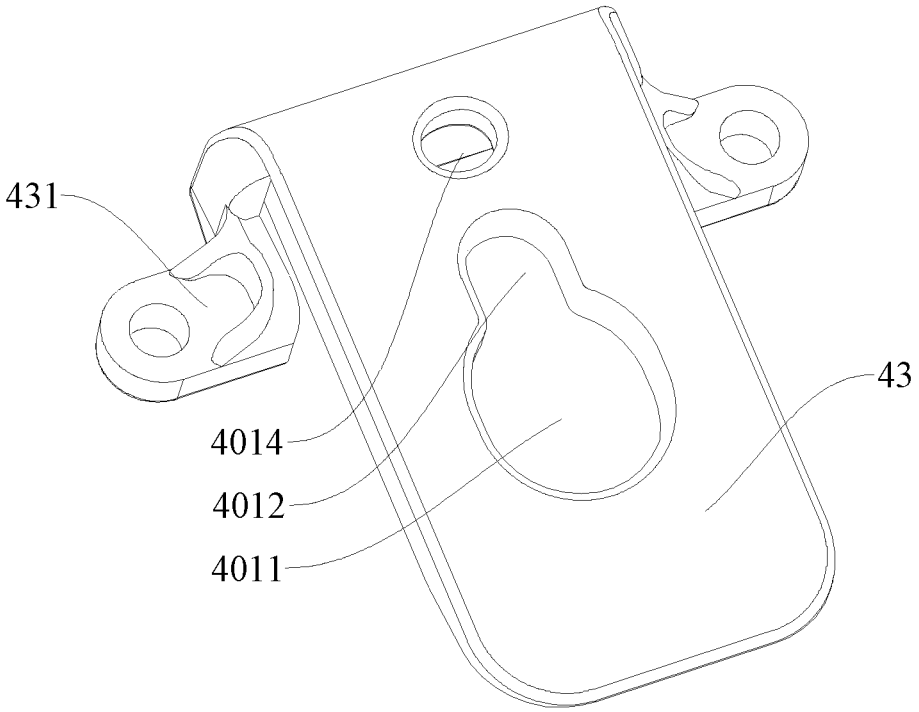
FIG. 29 is a schematic view illustrating the hook module of the cordless lamp illustrated in FIG. 28.

In some embodiments, as illustrated in FIGS. 28 to 29, the hook module 4 further includes a fourth plate member 43 with mounting lugs 431 provided on two opposite sidewalls of the fourth plate member 43 and with the nail hanging hole 401 provided thereon. The hook module 4 is connected to the bottom housing 1 through the connecting member arranged through the mounting lug 431. It can be understood that the whole cordless lamp needs to be fixed at a certain angle in some specific use occasions. At this moment, if the hook module 4 is capable of rotating relative to the bottom housing 1, it will affect the normal use of the cordless lamp instead. However, in the present embodiment, since the hook module 4 is fixed on the bottom housing 1 through the connecting member arranged through the mounting lug 431, the connection stability between the hook module 4 and the bottom housing 1 is ensured, thereby preventing the hook module 4 from rotating relative to the bottom housing and improving using satisfaction of the user.

As illustrated in FIG. 8, the nail hanging hole 401 includes the first elongated hole 4011, the second elongated hole 4012 and a closed hole 4014. The width of the first elongated hole 4011 is greater than that of the second elongated hole 4012. The second elongated hole 4012 is connected to one end of the first elongated hole 4011 facing toward the mounting lug 431. It can be understood that during the nail hanging process, the first elongated hole 4011 is relatively wide, which facilitates extending the nail cap into the nail hanging hole 401, while the second elongated hole 4012 is relatively narrow to restrict the nail cap from sliding out of the nail hanging hole 401 on a premise that the nail body is capable of passing through, which ensures that the hanging nail can be stably maintained in the nail hanging hole 401, thereby ensuring the nail hanging stability of the cordless lamp. However, arrangement of the closed hole 4014 enables the cordless lamp to be applied to special use scenarios. For example, in some practical occasions, the hanging nail is a stud instead of a screw. Stability of the whole cordless lamp can be better ensured by mating the closed hole 4014 with the stud.

Typically, the fourth plate member 43 and the mounting lug 431 are integrally formed.

Therefore, structural stability of the hook module 4 is improved, avoiding a phenomenon that the mounting lug 431 is broken.

Typically, the fourth plate member 43 and the mounting lug 431 are plastic members. Therefore, production cost and weight of the hook module 4 can be reduced, and wear resistance and corrosion resistance of the hook module 4 are improved. Certainly, in other embodiments of the present disclosure, the fourth plate member 43 and the mounting lug 431 may be selected from any material according to actual needs and are not limited to the plastic of the present embodiment.

In some embodiments, a front side and a rear side of the bottom housing 1 are provided with a first curved portion 14, respectively. A front side and a rear side of the cover housing 2 are provided with a second curved portion 23, respectively. The second curved portion 23 is arranged corresponding to the first curved portion 14. The first curved portion 14 and the second curved portion 23 define a curved battery compartment 101. A cross section of the curved battery compartment 101 is a partial circle ranges from ½ to ¾ of one circle.

It should be noted that a battery compartment in a housing of a cordless lamp of the existing art either adopts a packaged type with poor heat dissipation effect or adopts a fully open type that cannot well secures a power source 9. In the present embodiment, the curved battery compartment 101 is formed of the first curved portion 14 of the bottom housing 1 and the second curved portion 23 of the cover housing 2. That is, the curved battery compartment 101 of the present embodiment is a semi-open battery compartment, which can not only improve stability of the power source 9 but ensure a better heat dissipation effect. In addition, since the cordless lamp includes two curved battery compartments 101, one power source 9 can be mounted in each battery compartment, thereby improving endurance of the cordless lamp.

Typically, the power source 9 is a high-efficiency charging power source 9. Therefore, the endurance of the cordless lamp can be further improved.

Typically, a cross section of the curved battery compartment 101 ranges from ⅗ to ⅔ of one circle.

Typically, a cross section of the first curved portion 14 accounts for ⅛ of one circle, and a cross section of the second curved portion 23 accounts for ¼ of one circle.

Typically, the cross section of the first curved portion 14 accounts for ½ of one circle, and the cross section of the second curved portion 23 accounts for ⅜ of one circle.

In this embodiment, it is noted that the cross-sectional shapes of the curved battery compartment 101, the first curved portion 14 and the second curved portion 23 can be selected according to actual needs, and will not be limited to the above description.

Typically, the two curved battery compartments 101 are located on two sides of a circuit board 32, thereby reducing a lateral width of the cordless lamp.

Figure 3:
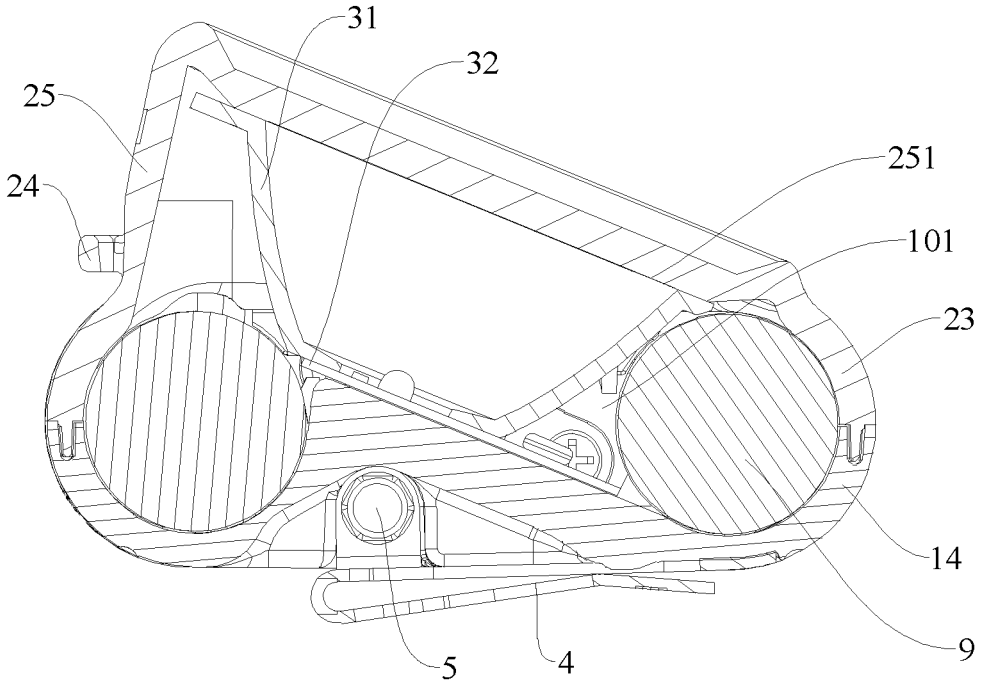
FIG. 3 is a sectional view of the cordless lamp illustrated in FIG. 1 from another angle.

In some embodiments, as illustrated in FIG. 3, the cover housing 2 includes the main body 24 and a lamp hood 25 protruding from the main body 24. The lamp hood 25 has a light outbound surface 251, and the light outbound surface 251 is arranged at an included angle with the bottom wall of the cover housing 2.

It should be noted that a lamp hood 25 or lamp glass of the existing art is disposed coplanar with the main body 24. After other components (e.g., the power source 9, the circuit board 32, etc.) of the cordless lamp are mounted together on the main body 24, heavier components such as the power source 9 and components such as the reflecting cup 31 of the cordless lamp are disposed at a same relative position. These heavier components cause a relatively large position offset of the center of gravity of the whole cordless lamp relative to the hook module 4 of the cordless lamp, and the user feels that the cordless lamp is relatively heavy and uncomfortable when hanging the cordless lamp by the hook on a safety helmet.

In the present embodiment, the lamp hood 25 is arranged protruding from the main body 24, so that during a mounting process, the lamp hood 25 is used for mounting the reflecting cup 31 of the cordless lamp, and other heavier components such as the power source 9, the circuit board 32 are mounted in the main body 24, so that the position offset of the center of gravity of the whole cordless lamp relative to the hook module 4 of the cordless lamp is reduced, and the user feels that an overall weight is relatively light when using the cordless lamp.

In some specific embodiments, the main body 24 and the lamp hood 25 are of an integrated structure, so that the structure is simple and the lamp hood 25 and the main body 24 do not need to be connected and mounted again, simplifying a structure of the cover housing 2, thereby improving an aesthetic degree of the cordless lamp. In addition, the main body 24 and the lamp hood 25 can be integrally molded with transparent plastic, so that the main body 24 and the lamp hood 25 can be molded by an injection molding method. A processing technology is simple and corresponding economic benefits are quite good.

In some specific embodiments, an included angle between the light outbound surface 251 and the bottom wall of the cover housing 2 is 22°. Because in most cases, the cordless lamp is used with an illuminating angle of 22°, the included angle between the light outbound surface 251 and the bottom wall of the cover housing 2 is set to 22°, so that when mounting the cordless lamp, it is not necessary to rotate the cordless lamp, thereby facilitating mounting the cordless lamp.

In some specific embodiments, the light outbound surface 251 is recessed in the lamp hood 25, so as to reduce possibility of scratches on the light outbound surface 251, thereby ensuring light-emitting stability of the cordless lamp.

In some specific embodiments, a rope hanging device is provided at a protruding end of the lamp hood 25 adjacent to the main body 24, thereby facilitating hanging the cordless lamp by a hanging rope and improving the user satisfaction of the cordless lamp.

Figure 4:
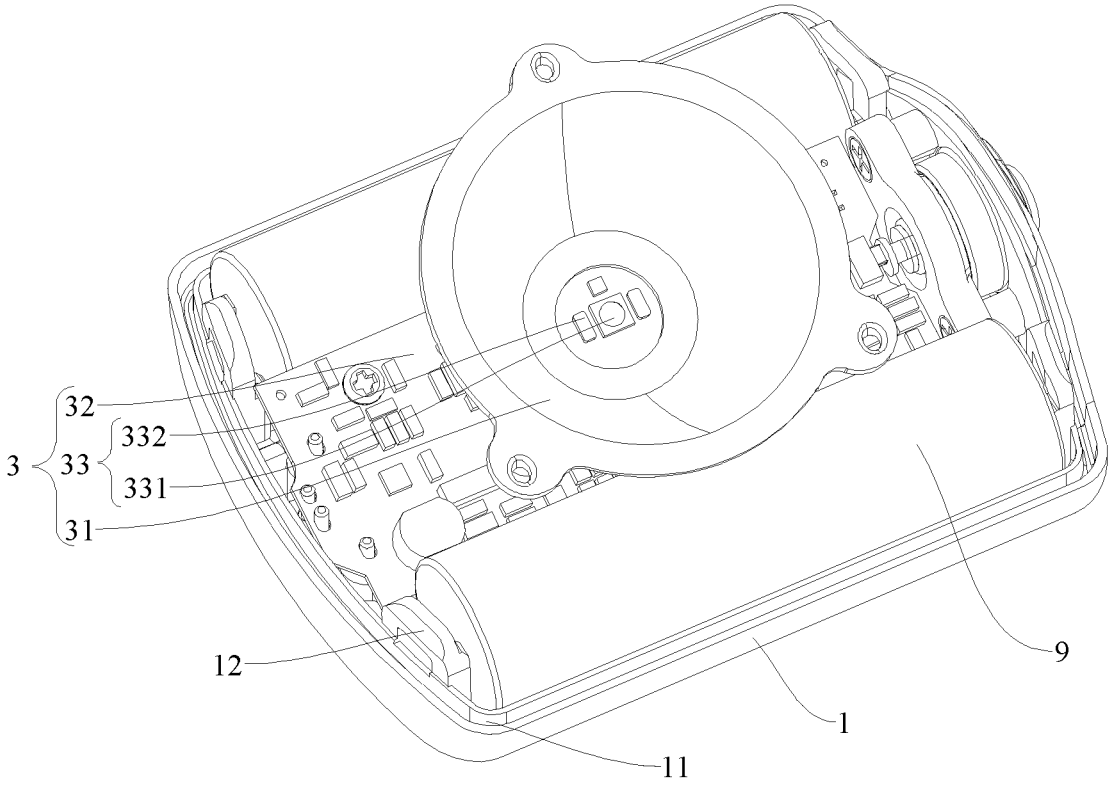
FIG. 4 is a schematic view illustrating the cordless lamp illustrated in FIG. 1 with the cover housing removed.

In some embodiments, as illustrated in FIG. 4, the light-emitting module 3 includes the light-emitting cover 31 and the circuit board 32. The light-emitting cover 31 is arranged in the lamp hood 25, and a top wall of the light-emitting cover 31 abuts against the light outbound surface 251. A bottom wall of the light-emitting cover 31 is provided with a matching hole. The circuit board 32 is provided with a light-emitting element 33 fitted with the matching hole.

Therefore, the reflecting cup 31 is capable of increasing a light-emitting range of the light-emitting element 33, thereby ensuring an illuminating range of the cordless lamp of the present embodiment.

In some specific embodiments, the bottom housing 1 is provided with a supporting bump 16, and the circuit board 32 is sandwiched between the supporting bump 16 and the reflecting cup 31.

It should be noted that in the existing art, the circuit board 32 is mostly fixed in forms such as screws, which usually wastes a large internal space of the circuit board 32, thereby increasing an external volume of the cordless lamp. In the present embodiment, the circuit board 32 is sandwiched between a bottom portion of the reflecting cup 31 and the support, thereby greatly saving the internal space and reducing a size of a housing of the cordless lamp.

Typically, an included angle between the circuit board 32 and a horizontal plane perpendicular to the bottom wall of the bottom housing 1 ranging from 90° to 160°. It should be noted that the circuit board 32 of the existing cordless lamp mostly adopts a fixing method that is set at 90° perpendicular to the horizontal plane. In this fixing method, users often need to lower their heads in order to clearly see situations below, thereby reducing comfort of a user experience process. However, in the present embodiment, an included angle between the circuit board 32 and the horizontal plane perpendicular to the bottom wall of the bottom housing 1 ranges from 90° to 160°, so that the user can clearly see the situation below without lowering his head, thereby greatly improving the comfort of the user experience process.

Further, the included angle between the circuit board 32 and the horizontal plane perpendicular to the bottom wall of the bottom housing 1 ranges from 100° to 240°, which is more in line with ergonomic requirements of the user experience process.

In some specific embodiments, as illustrated in FIGS. 15 to 19, the circuit board 32 is provided with a mounting hole 321, and the bottom wall of the reflecting cup 31 is provided with a mounting protrusion 311 fitted with the mounting hole 321. The reflecting cup is fixedly connected to the circuit board 31 through an integrally formed mounting protrusion 311, so that stability of the connection between the reflecting cup 31 and the circuit board 32 is improved, thereby ensuring a center coincidence spotlighting effect of a main light source 331, and ensuring the illuminating effect of the cordless lamp.

Advantageously, the mounting projection 311 is formed as a trapezoidal snap, and a structure of the trapezoidal snap itself forms a certain radian, making it more convenient for using a mold, at the same time, the trapezoidal snap is connected to a cross section of the circuit board 32 to form a circular arc surface connection without damaging a structure of the circuit board 32, so that the reflecting cup 31 is effectively fixed on the circuit board without causing contact wear to the circuit board 32. In addition, a bottom portion of the reflecting cup 31 located at an outer side of the trapezoidal snap is provided with a hollow-out hole. The hollowed-out hole can provide deformation space for the trapezoidal snap, which is beneficial to elastic deformation and reset when the trapezoidal snap is clamped with the circuit board 32. The reflecting cup 31 and the trapezoidal snap are integrally injection molded with PC material. Aluminum is electroplated on a surface of the reflecting cup 31 by vacuum electroplating, thereby effectively improving the light-emitting efficiency of the light-emitting element 33.

Figure 18:
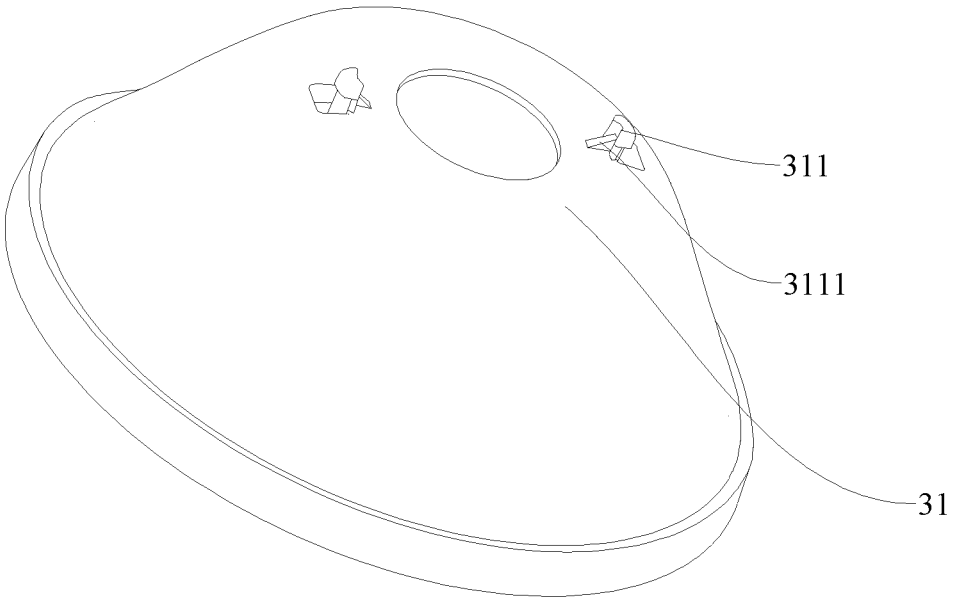
FIG. 18 is a schematic view illustrating a reflecting cup of a cordless lamp of another embodiment of the present disclosure.

Advantageously, as illustrated in FIG. 18, a reinforcing structure 3111 connected to the bottom wall of the reflecting cup 31 is provided on the mounting protrusion 311. It can be understood that the reinforcing structure 3111 is capable of improving strength of the mounting protrusion 311, so that connection stability after the mounting protrusion 311 is clamped into the mounting hole 321 is improved, thereby improving connection stability of the reflecting cup 31 and the circuit board 32.

Optionally, the reinforcing structure 3111 is formed as an L-shaped structure. Certainly, the reinforcing structure 3111 may select other structures, such as triangular structures, according to actual needs. The reinforcing structure 3111 is not limited to the L-shaped structure of the present embodiment.

In some specific embodiments, as illustrated in FIGS. 20 to 27, the light-emitting module 3 further includes a reflecting element 34 disposed in the reflecting cup 31. One end of the reflecting element 34 is disposed corresponding to the light-emitting element 33, and a center line of the reflecting element 34 coincides with an axis of the reflecting cup 31.

It can be understood that in the existing art, in order to increase an illuminating wide angle of the light-emitting element 33, it is necessary to change a curve of an inner surface of the reflecting cup 31. After changing the curve of the inner surface of the reflecting cup 31, although the illuminating wide angle of the light-emitting element 33 is increased, focusing brightness of the whole cordless lamp is reduced, seriously affecting performance of the cordless lamp. However, in the present embodiment, one reflecting element 34 is added into the reflecting cup 31. When light from the light-emitting element 33 is irradiated to a side surface of the reflecting element 34, the light is reflected by the side surface, so that the light reaches an outer portion of the reflecting cup 31, thereby increasing the wide angle of the light-emitting element 33. Since the curve of the inner surface of the reflecting cup 31 is not changed, the focusing brightness of the whole cordless lamp will not be affected.

Figure 19:
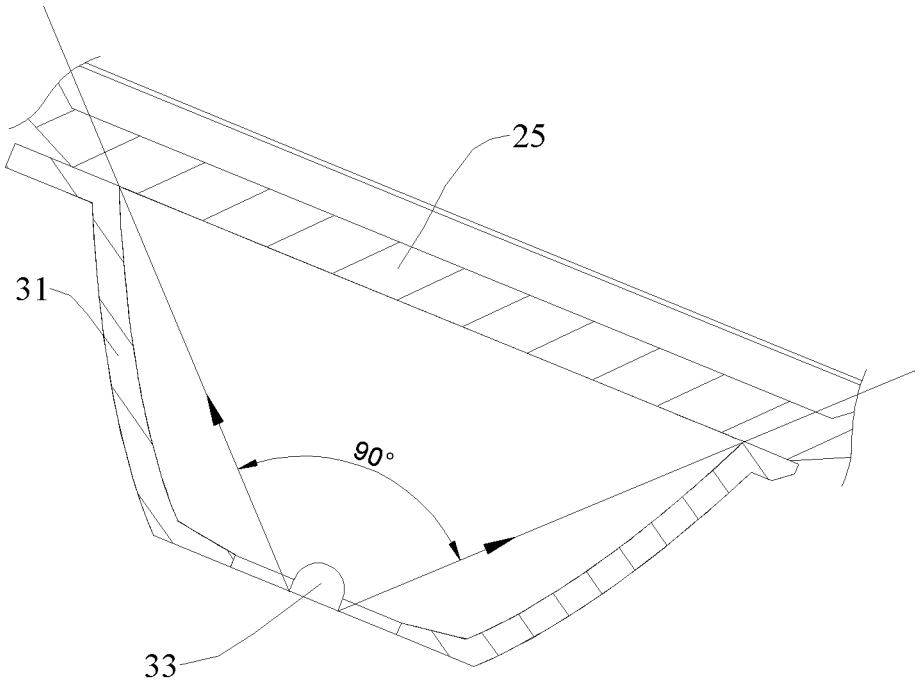
FIG. 19 is a schematic view illustrating an range of illumination of the cordless lamp of an embodiment of the present disclosure when a reflecting element is not provided.
Figure 20:
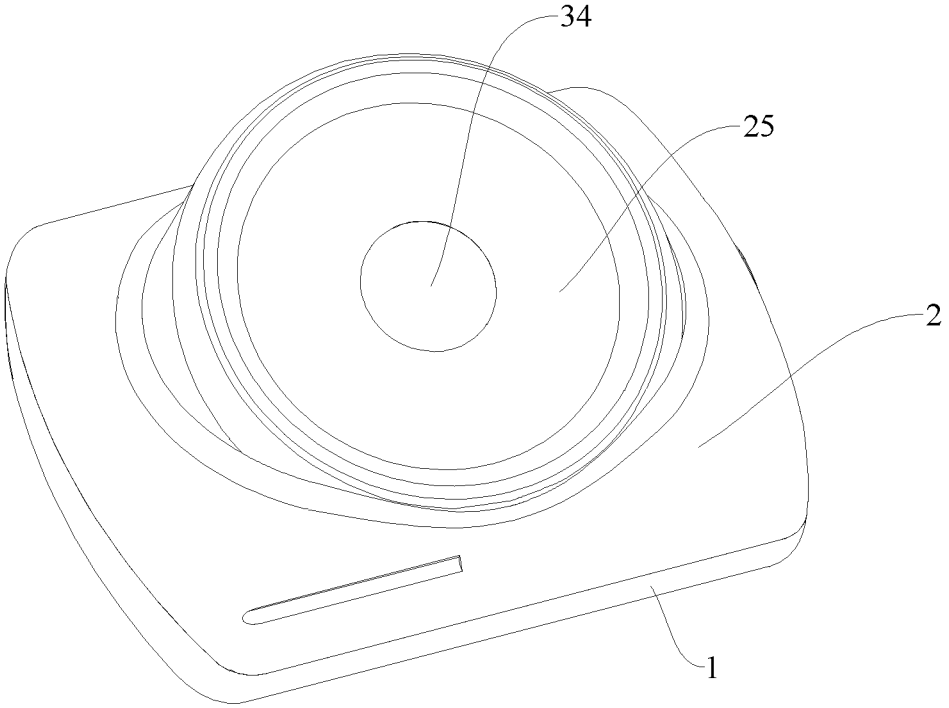
FIG. 20 is a schematic view illustrating the cordless lamp with the reflecting element of an embodiment of the present disclosure.
Figure 21:
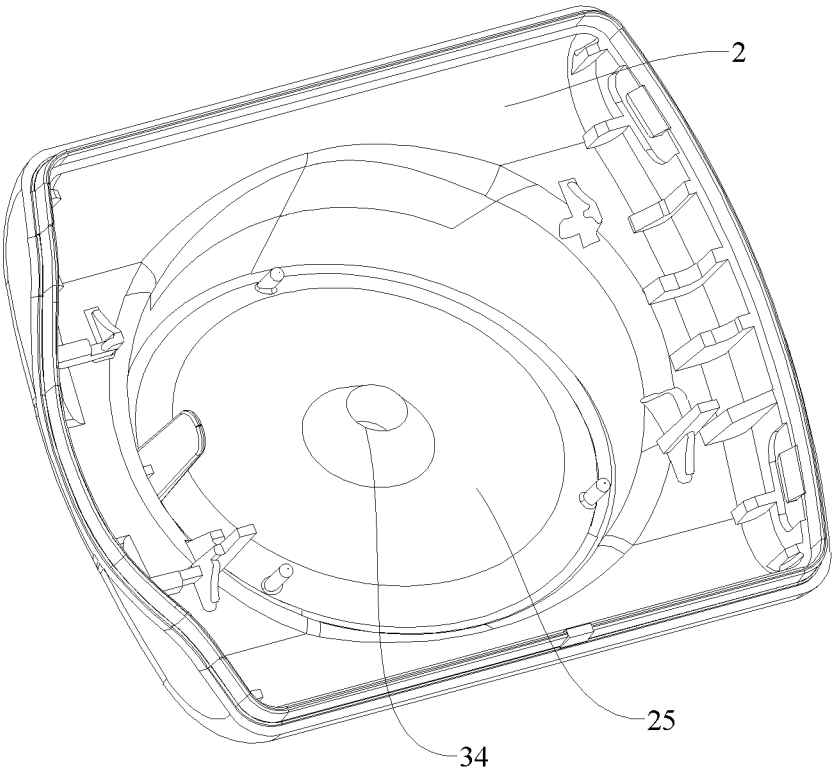
FIG. 21 is a schematic view illustrating a partial structure of the cordless lamp illustrated in FIG. 20.
Figure 22:
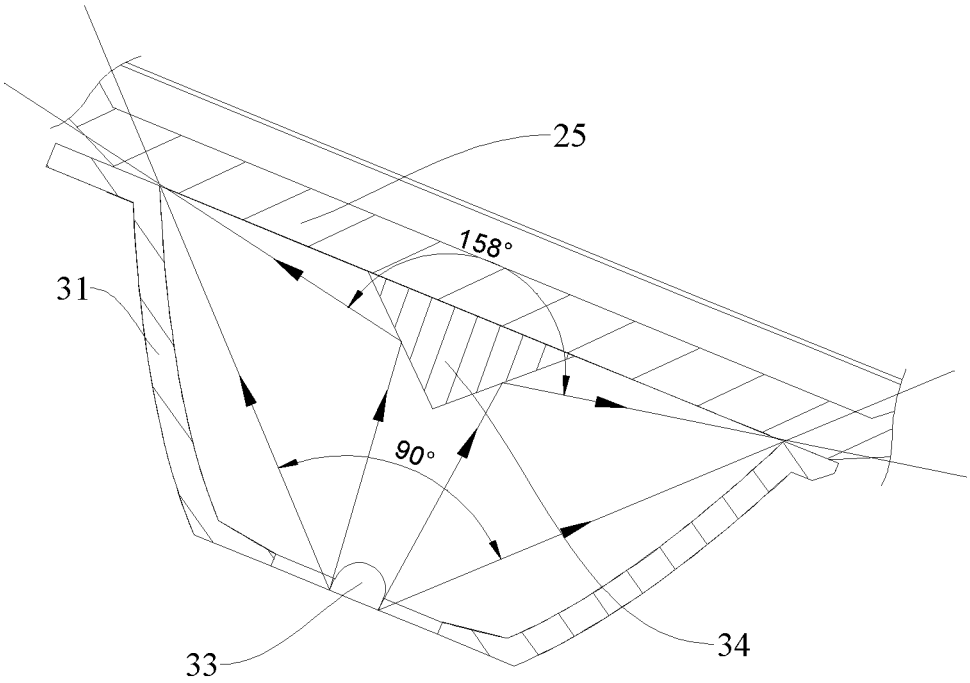
FIG. 22 is a schematic view illustrating a range of illumination of the cordless lamp of an embodiment of the present disclosure when the reflecting element is provided.
Figure 23:
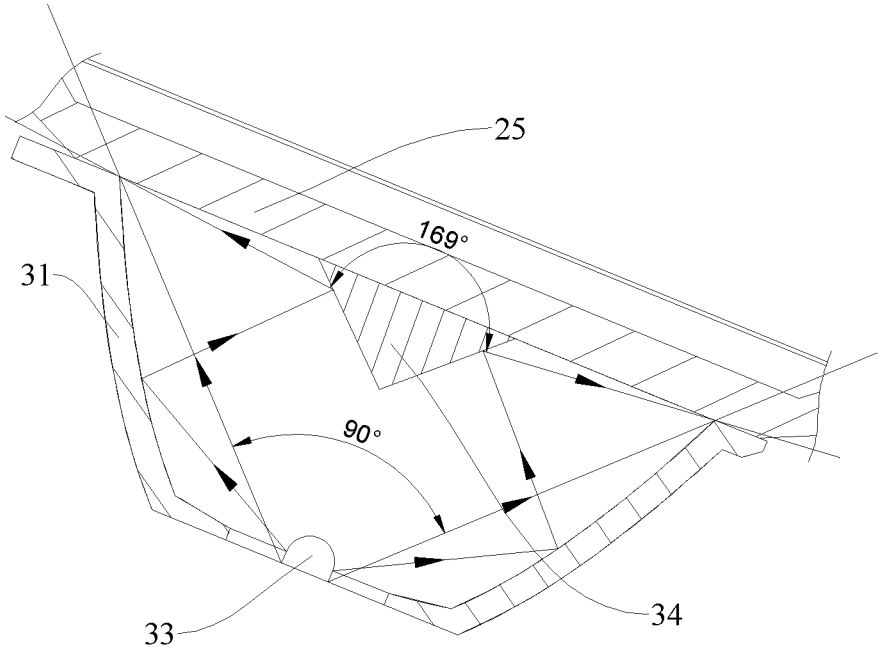
FIG. 23 is a schematic view illustrating another range of illumination of the cordless lamp illustrated in FIG. 22 when the reflecting element is provided.
Figure 24:
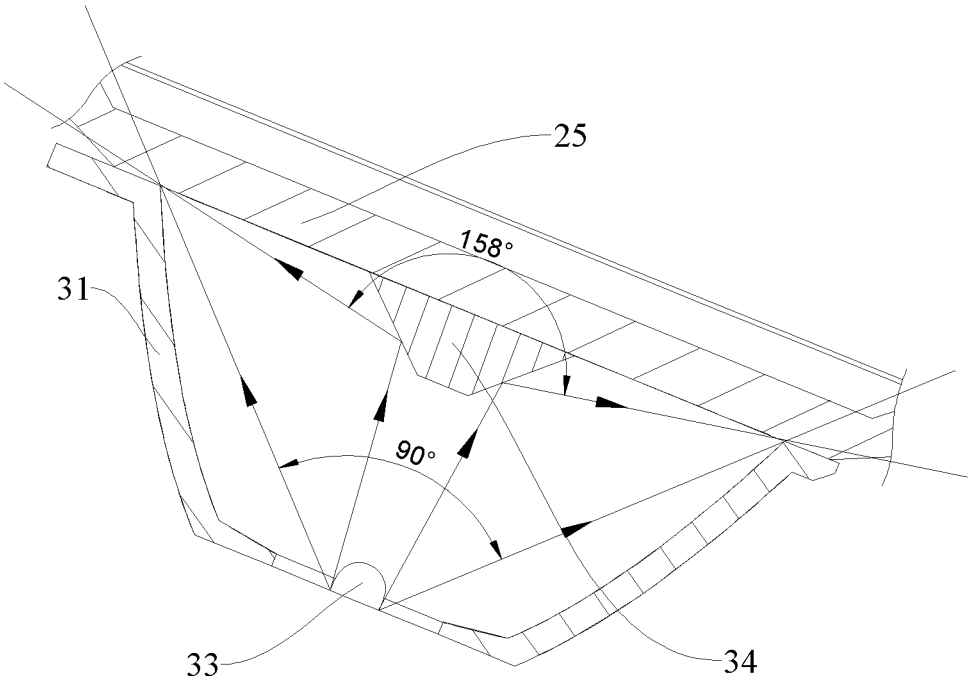
FIG. 24 is a schematic view illustrating a range of illumination of the cordless lamp of an embodiment of the present disclosure when a reflecting element of another type is provided.
Figure 25:
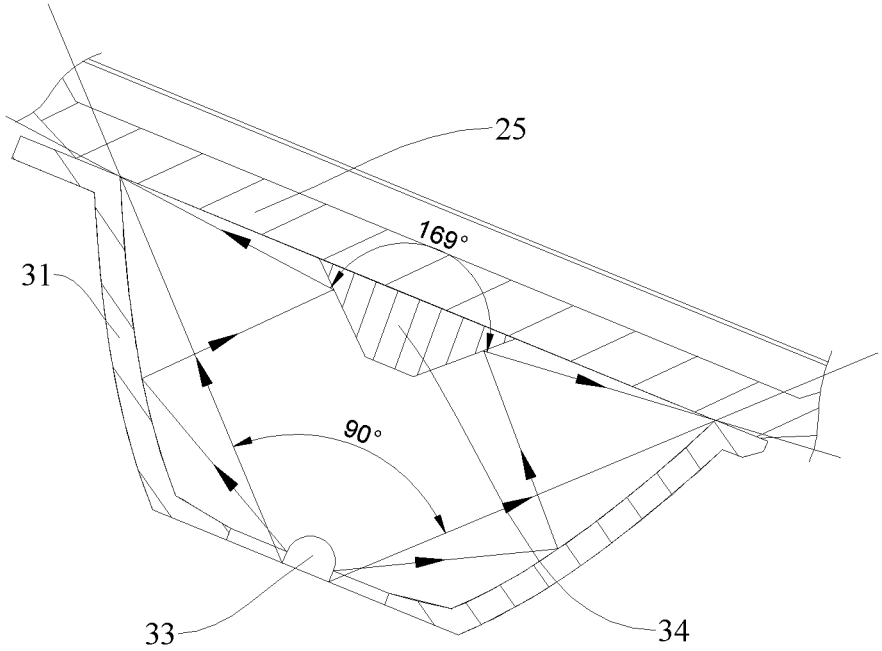
FIG. 25 is a schematic view illustrating another range of illumination of the cordless lamp illustrated in FIG. 24 when the reflecting element is provided.
Figure 26:
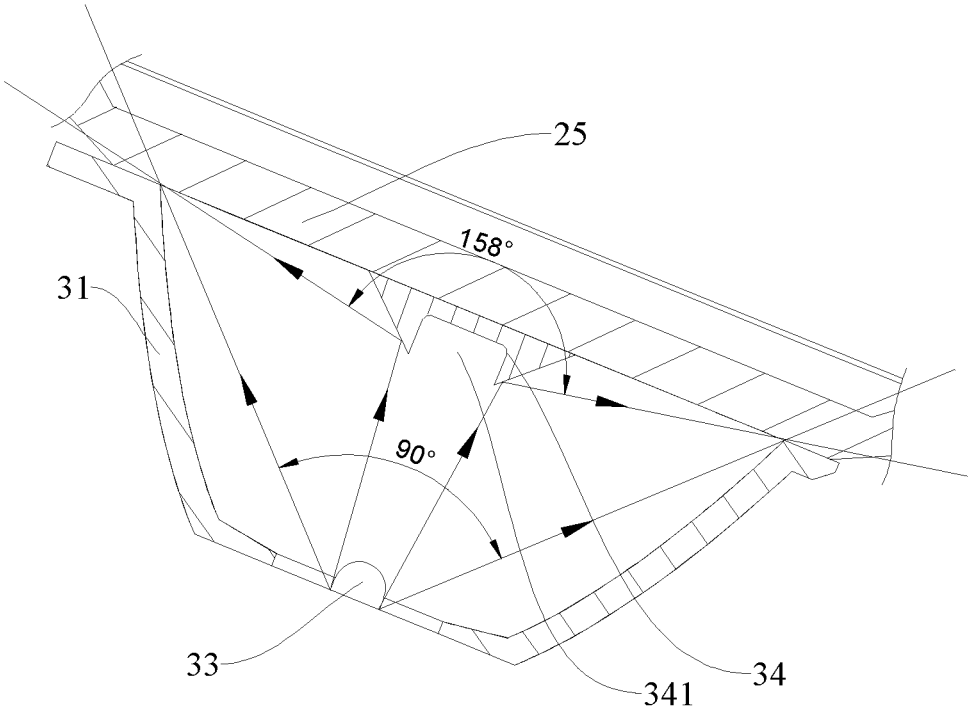
FIG. 26 is a schematic view illustrating a range of illumination of the cordless lamp of an embodiment of the present disclosure when a reflecting element of another type is provided.
Figure 27:
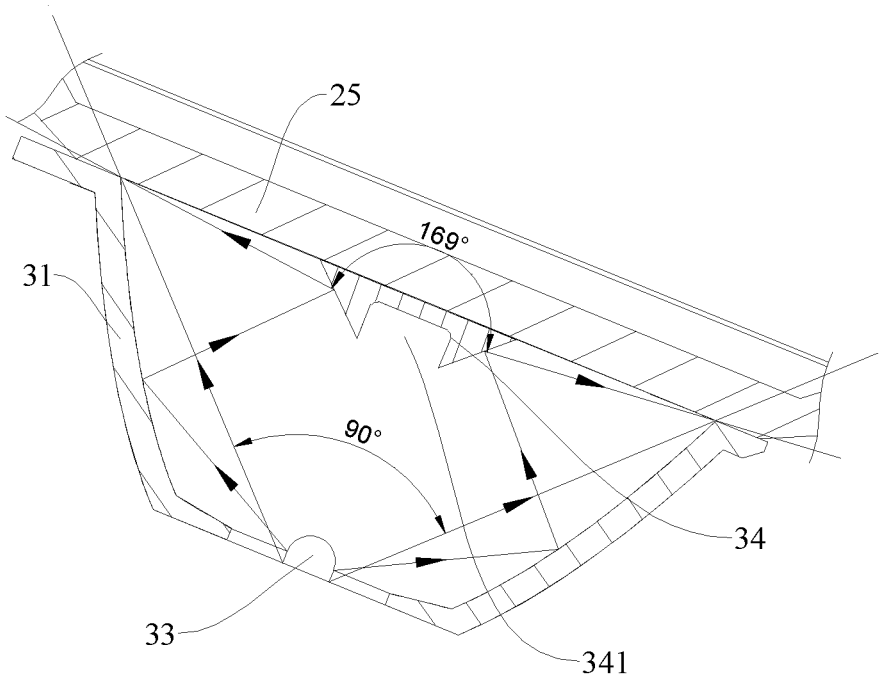
FIG. 27 is a schematic view illustrating another range of illumination of the cordless lamp illustrated in FIG. 26 when the reflecting element is provided.

Specifically, as illustrated in FIG. 19, when the reflecting element 34 is not provided in the reflecting cup 31, the light emitted from the light-emitting element 33 is emitted from an edge of the reflecting cup 31. It can be seen from FIG. 19 that the wide illuminating angle of the light-emitting element 33 is 90°. As illustrated in FIGS. 22, 24, and 26, when the reflecting element 34 is provided in the reflecting cup 31, the light emitted from the light-emitting element 33 is reflected by the reflecting element 34 and then emitted from the edge of the reflecting cup 31, making the wide illuminating angle of the light-emitting element 33 become 158°. That is, reflected light on a surface of the reflecting element 34 makes up for a range in which a reflection cover 1 cannot form a wide angle, that is, a range spanning from 90° to 158°. More advantageously, as illustrated in FIGS. 23, 25, and 27, when the reflecting element 34 is provided in the reflecting cup 31, after reflected by the reflecting cup 31 for a first time, the light emitted from the light-emitting element 33 is reflected by the reflecting element 34 for a second time, and then emitted just from the edge of the reflecting cup 31, so that the wide angle of the light-emitting element 33 becomes 169°. That is, the light emitted from the light-emitting element 33 is reflected for two times by the reflecting cup 31 and the reflecting element 34. The two times reflection light makes up for a range in which the reflection cover 1 cannot form a wide angle, that is, a range ranges from 158° to 169°. Therefore, the wide angle of the light-emitting element 33 is further increased. In summary, when the light-emitting element 33 is added into the reflecting cup 31, the wide angle of the light-emitting element 33 is increased, while the curve of the inner surface of the reflecting cup 31 is not changed, so that the focusing brightness of the whole cordless lamp is not affected.

Optionally, in practice, when provided, the reflecting element 34 can be selected according to actual needs. As illustrated in FIG. 22, the reflecting element 34 may be a cone adhesive to the lamp hood 25.

As illustrated in FIG. 24, the reflecting element 34 may be a frustum of a cone adhesive to the lamp hood 25. The reflecting element 34 has a structure of a frustum of a cone. Compared with the conical structure, the light-emitting element with the shape of a frustum of a cone enables the light emitted from the light-emitting element 33 to be directly emitted out without being reflected by a top portion of the cone and the reflecting cup 31, thereby reducing a reflection loss and improving illuminating brightness of the cordless lamp.

As illustrated in FIG. 26, the reflecting element 34 may be in the shape of a frustum of a cone with a hollow structure 341 adhesive to the lamp hood 25. The hollow structure 341 forms a concave lens structure on a bottom surface of the reflecting element 34 and an inner surface of the lamp hood 25, so that a position where the light-emitting element forms a critical reflection point with a wide angle of 158° is near a small end of the reflecting element 34, which further reduces a height of the reflecting element 34, thereby further reducing loss of light emitted by the light source 2 due to reflection of the small end of the reflecting element 34.

Certainly, it should be added herein that the above description is only an exemplary illustration of the reflecting element 34 and is not a complete limitation of the reflecting element 34. That is, in other embodiments of the present disclosure, the reflecting element 34 can be selected according to actual needs, and a maximum wide angle of the light-emitting element 34 is not limited to 158°.

Advantageously, a frosted structure is located at a position of the reflecting element 34 corresponding to an outer surface of the lamp hood 25. Since a frosted surface can scatter light, a shadow formed by the reflecting element 34 on the light outbound surface 251 is reduced, thereby further enhancing the focusing brightness of the cordless lamp.

Advantageously, the reflecting element 34 is made of transparent material, and most of the light emitted from the light-emitting element 33 can pass through the reflecting element 34, so that the focusing brightness of the cordless lamp is improved.

Figure 5:
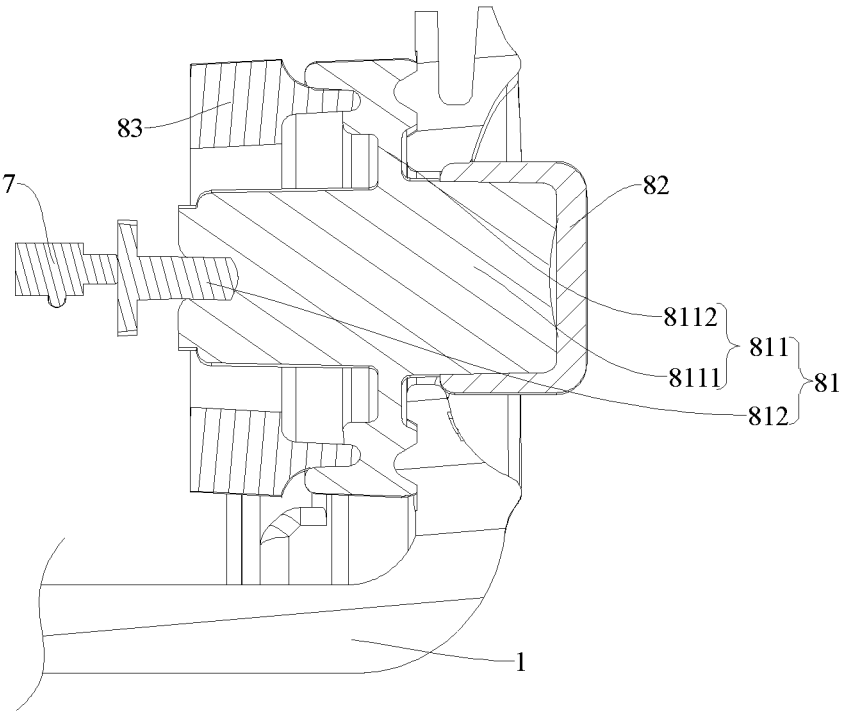
FIG. 5 is a partial sectional view illustrating a button assembly of the cordless lamp illustrated

In some embodiments, as illustrated in FIG. 5, the cordless lamp further includes a switch 7 and a button assembly 8. The switch 7 is arranged between that bottom housing 1 and the cover housing 2. The mounting hole is provided on the bottom housing 1. The switch 7 is electrically connected to the circuit board 32. The switch 7 is used for controlling starting and closing of the light-emitting element 33. The switch 7 is provided with a trigger surface. The button assembly 8 includes a key 81 and a protective cover 82. The key 81 is arranged through the mounting hole, and one end of the key 81 is capable of abutting against the trigger surface. The protective cover 82 is sleeved on another end of the key 81 and abutted against a sidewall of the housing.

It should be noted that, in the existing art, a tact switch 7 for the cordless lamp is generally connected to an external rubber button. Since the tact switch 7 is relatively sensitive, the cordless lamp will be lit by softly touching the rubber button. If the rubber button is accidentally touched during product handling and transportation, the cordless lamp will be in a lit state all the time, which causes loss of built-in power of the cordless lamp, thereby affecting quality of product delivery.

However, in the present embodiment, an additional protective cover 82 effectively prevents the key 81 from being touched during the product handling and transportation process, thereby avoiding misoperation of the switch 7. Therefore, the situation that the built-in power loss caused by the lighting of the cordless lamp during the handling process will affect the quality of the product delivery is avoided.

In some embodiments, as illustrated in FIG. 5, the key 81 includes a flexible member 811 and a rigid member 812 embedded at an opposite end of the flexible member 811 and a trigger surface of the switch 7. It can be understood that if the flexible member 811 is in direct contact with the trigger surface, during long-term use, it is easy to cause material fatigue, aging and other phenomena at an end of the flexible member 811 that is in contact with the trigger surface, thereby making the flexible member 811 ineffective when pressed and unable to be used normally. The rigid member 812 added in the present embodiment can effectively prevent the flexible member 811 from being in direct contact with the trigger surface of the switch 7, thereby effectively improving a service life of the key 81 and improving reliability when the key 81 is pressed. At the same time, operation hand feeling of the key 81 is effectively improved, which effectively avoids occurrence of conditions such as pressing failure of the key 81.

Typically, the flexible member 811 is integrally injection molded from a rubber material, while the rigid member 812 is integrally injection molded from a plastic material.

Typically, an end of the flexible member 811 is provided with a positioning hole along an axial direction, and a positioning rod of the rigid member 812 is inserted in the positioning hole, so that connection stability between the flexible member 811 and the rigid member 812 can be better ensured, thereby using reliability of the key 81 is ensured.

In some more specific embodiments, As illustrated in FIG. 5, the button assembly 8 further includes a mounting plate 83 connected to an inner sidewall of the housing. The flexible member 811 includes a body 8111 and a protruding ring 8112 arranged around the body 8111. An end of the body 8111 passes through the housing to get mated with the protective cover 82, and another end passes through the mounting plate 83 to get mated with the rigid member 812. The protruding ring 8112 is sandwiched between the mounting plate 83 and the inner sidewall of the housing. Therefore, the mounting plate 83 is capable of firmly pressing the key 81 in the housing, thereby better ensuring stability of the key 81.

Typically, one of the body 8111 and the sidewall of the housing is openly provided with an annular mounting groove 8121, and the other one is provided with a mounting bump adapted to the mounting groove 8121. In addition, since the housing is openly provided with the mounting hole, the sealing performance of the whole cordless lamp is reduced to a certain extent. In the present embodiment, sealing at the mounting hole is better realized by mating of the mounting bump and the mounting groove 8121 and the pressing effect of the mounting plate 83 on the protruding ring 8112, thereby ensuring the sealing performance of the cordless lamp.

Figure 10:
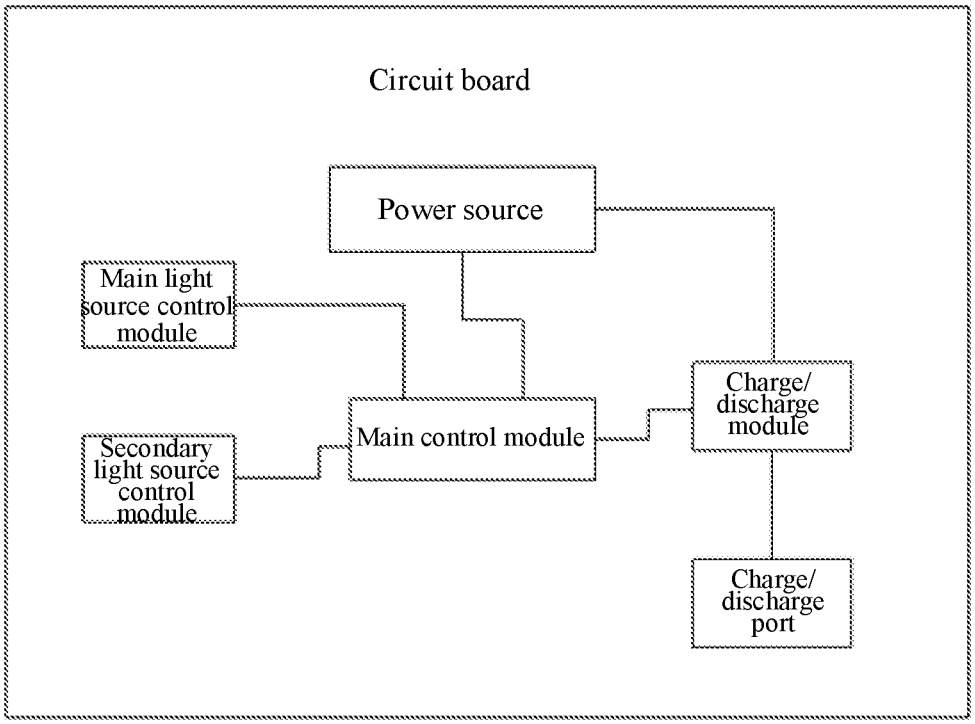
FIG. 10 is a schematic diagram illustrating composition of a circuit board of the cordless lamp illustrated in FIG. 1.

In some embodiments, as illustrated in FIG. 10, the circuit board 32 include a main control module, a light source control module, a charge management module, a discharge management module and a light source control module. The charge management module and the discharge management module each are electrically connected to the main control module. The light source control module is electrically connected to the light-emitting element 33. The charge management module and the discharge management module each are electrically connected to the power source 9. At least one of the bottom housing 1 and the cover housing 2 are provided with a charge interface and a discharge interface. A charge structure is electrically connected to the charge management module. The discharge interface is electrically connected to the discharge management module. It can be understood that since the circuit board 32 of the cordless lamp of the present disclosure includes the charge management module, and the discharge management module, that is to say, the cordless lamp of the present disclosure has a charge function and a discharge function. On the one hand, there is no need to replace the power source 9 in the cordless lamp, thereby reducing use cost of the cordless lamp. On the other hand, the cordless lamp is capable of charging other external devices, thereby expanding a use range of the cordless lamp.

In some specific embodiments, the charge management module and the discharge management module are integrated into a charge/discharge module, and the charge interface and the discharge interface are integrated into a charge/discharge port 6. Therefore, the structure of the circuit board 32 is simplified, and hole/groove structures on the bottom housing 1 and the cover housing 2 are reduced, thereby indirectly improving the sealing performance of the cordless lamp of the embodiment of the present disclosure.

Typically, the circuit board 32 is further provided with a charge/discharge indicator lamp electrically connected to the charge/discharge module. Therefore, the charge/discharge indicator lamp is capable of indicating a charging/discharging state of the cordless lamp, thereby giving a very intuitive display to the user.

Typically, the charge/discharge port 6 is a non-plug type magnetic interface. It can be understood that the non-plug type magnetic interface ensures that the charge/discharge port has good sealing performance with the bottom housing 1 or the cover housing 2. At the same time, an interface area 61 has no groove structure, making it not affected by foreign objects.

In some specific embodiments, as illustrated in FIG. 6, the charge/discharge port 6 includes the interface area 61 formed on the bottom wall of the housing. The interface area 61 is provided with two charge/discharge contact points 62 protruding on the interface area 61. The interface area 61 is covered with patches, and additionally or alternatively, the two charge/discharge contact points 62 are magnetic contact points. It can be understood that since the charge/discharge contact points 62 protrude out from the interface area 61, there is no groove structure at an electrical connection of the whole charge/discharge interface. Therefore, the electrical connection is not affected by foreign objects after completion, and an integral clamping groove type charging and discharging can be used. At the same time, since the interface area 61 is coat with stainless iron sheets or/and the charge/discharge contact points 62 as magnetic contact points, the magnetic contact charger connector can be used to charge a device through a magnetic force adsorption of the stainless iron sheets or/and the charge/discharge contact points 62 of the magnetic contact points, which is very convenient.

Typically, a top portion of the charge/discharge contact point 62 is flush with the bottom wall of the bottom housing 1, and the interface area 61 is located at an edge position of the bottom housing 1. It can be understood that since an area of the interface are 61 is relatively small, the bottom wall of the bottom housing 1 is flush with a top portion of the charge/discharge contact point 62, so that a surface of the bottom housing 1 of the whole cordless lamp is relatively flat. At the same time, the interface area 61 is located at the edge position of the interface bottom housing 1. When the device uses the integral clamping charging mode, an elastic charging electrode of a charger will not contact the interface area 61 and scratch the bottom housing 1.

Typically, the bottom housing 1 is a plastic member, and a side surface of the charge/discharge contact point is sealed by the interface area 61 by injection molding. Therefore, the side surface of the charge/discharge contact point 62 and the interface area 61 are sealed by injection molding, thereby improving the sealing performance of the whole cordless lamp.

Typically, as illustrated in FIG. 7, the circuit board 32 is provided with a welding hole 322. An end of the charge/discharge contact point 62 is fitted with the welding hole 322 and is fixed to the circuit board 32 by soldering. In this way, connection stability between the charge/discharge contact point 62 and the circuit board 32 can be better ensured, which improves reliability, impact resistance and explosion-proof performance of the cordless lamp, thereby ensuring stable charging and discharging of the cordless lamp.

Typically, as illustrated in FIG. 6, the interface area 61 is provided with a limit groove 612 and two guide grooves 611. The limit groove 612 and the two guide grooves 611 are distributed in an isosceles triangle. A length of the limit groove 612 is perpendicular to a length of the guide groove 611. It can be understood that when the magnetic contact charger connector is close to the interface area 61, the charge/discharge connector and the charge/discharge contact point 62 will generate a relatively large magnetic absorption force. The guide groove 611 located at an outer side of the charge/discharge contact point 62 is mated with a guide boss on the charge/discharge connector, so that the charge/discharge connector and the charge/discharge contact point 62 are easily aligned and in good contact. The limit groove 612 in the interface area 61 is capable of well limiting a position of a charge/discharge connector. After the charging is completed, in removing the charge/discharge connector, the limit groove 612 serves as a fulcrum. Therefore, the charge/discharge connector can be easily removed.

Further, the limit groove 612 is an arc-shaped groove, whereby when the guide boss of the magnetic contact charge/discharge connector rotates in the arc-shaped groove, an arc-shaped structure of an inner surface of the groove makes the guide boss smoothly rotate and easily taken out.

In some more specific embodiments, as illustrated in FIGS. 1 and 6, the bottom housing 1 is provided with two first sliding grooves 15 on two sides of the interface area 61, and the cover housing 2 is provided with two second sliding grooves 26 on two sides of the interface area 61. It can be understood that the first sliding groove 15 and the second sliding groove 26 are used to position and clamp the cordless lamp onto the charge/discharge connector, thereby ensuring the stability of the cordless lamp.

In some specific embodiments, as illustrated in FIG. 4, the light-emitting element 33 includes the main light source 331 and a secondary light source 332 disposed around the main light source 331. The light source control module includes a main light source control module electrically connected to the main light source 331 and a secondary light source control module electrically connected to the secondary light source 332. Therefore, independent control of the main light source 331 and the secondary light source 332 enables the cordless lamp of the present embodiment to provide different light intensities and light-emitting effects, thereby expanding the use range of the cordless lamp.

Optionally, there are four secondary light sources 332, which can be individually controlled. In this way, the four secondary light sources 322 are capable of providing different combination prompts during a charge/discharge process of the cordless lamp, which can be applied in emergency or other scenes, thereby greatly improving the user experience.

Typically, the housing is provided with keys connected to the secondary light source control module. The user can press different keys according to actual needs so that the secondary light source 322 provides different combined illuminating prompts. Operation of such key switching is very convenient, so that the user is convenient to switch states of the secondary light source 322, thereby greatly improving the user experience.

In some embodiments, the bottom housing 1 or the cover housing 2 is provided with an information storage bar code, which is configured to store product information of the cordless lamp. It can be understood that arrangement of the information storage bar code is capable of realizing an anti-counterfeiting function of the cordless lamp.

Optionally, the information storage bar code can be a two-dimensional code, a non-contact Radio Frequency Identification (RFID) tag or a Near Field Communication (NFC) tag, etc.

Optionally, the information storage bar code can record identity information of the cordless lamp, such as a manufacturer of the cordless lamp, product parameters (such as a model of the lamp source) or a serial number.

Optionally, when the information storage barcode is an NFC chip, the NFC chip may contain a unique serial number. That is, each NFC tag corresponds to one unique random serial number (anticounterfeiting code). One serial number has N bits. A possibility of N is formed of a random combination of a total of 36 characters formed of 26 English letters and Arabic numerals of 0 to 9. Therefore, possibility of being counterfeited has (1/36) N kinds of possibilities. For example, with an 18-digit of a person's Identity Card, the possibility is only (1/36) 18=9. 695×10-29, and the possibility tends to 0 infinitely. Therefore, high anti-counterfeiting performance of a miner's lamp can be achieved. At the same time, data written in the NFC chip may be burned, and the user may only read the data. Content of the tag may also be encrypted. Ciphertext is written into the tag, and obtained ciphertext and serial number are sent to a decryption server to get decrypted, and then the decryption server feeds back a result.

In the description of the specification, the description of reference terms "an embodiment", "some embodiments" and the like means that a specific feature, structure, material, or characteristic described in connection with the embodiment or the example is included in at least one embodiment or example of the present disclosure. In the specification, the illustrative description of the preceding terms does not necessarily refer to the same embodiment or example. Moreover, the described specific features, structures, materials or characteristics may be combined in any suitable manner in one or more embodiments or examples.

The foregoing merely sets forth some illustrative embodiments according to the present disclosure. For those of ordinary skill in the art, various changes regarding specific implementations and application scopes are possible without departing from the scope and spirit of the present disclosure. The specification is not to be construed as limiting the present disclosure.

What is claimed is:

1. A cordless lamp comprising:

a bottom housing comprising an open upper end, which the open upper end of the bottom housing is provided with a clamping groove extending between an inner wall and an outer wall of the bottom housing around a periphery thereof and a snap ring that is arranged on the inner wall of the bottom housing;

a cover housing comprising an open lower end and interlocked with the bottom housing, wherein the cover housing is provided with a first locking protrusion extending from an inner wall of the cover housing to compliment location of the snap ring of the bottom housing and a second locking protrusion extending from a periphery of the cover housing, wherein the first locking protrusion is snap-fitted with the snap ring making the open upper end of the bottom housing abutting against the open lower end of the cover housing to form a first waterproof structure, and wherein the second locking protrusion is inserted into and fitted with the clamping groove, and an adhesive is filled between the second locking protrusion and the clamping groove to form a second waterproof structure; and a light-emitting module arranged between the bottom housing and the cover housing; the light-emitting module comprising a reflecting cup arranged in the cover housing and provided with a matching hole and a circuit board arranged on the bottom housing and comprising a light-emitting element that is arranged on the circuit board and fitted with the matching hole.

2. The cordless lamp of claim 1, further comprising:

a hook module, arranged on a bottom wall of the bottom housing, and comprising a mounting lug and a nail hanging hole;

a friction rotational shaft, wherein one end of the damping rotation shaft runs through the mounting lug, and another end of the friction rotational shaft is connected to the bottom housing;

wherein the hook module is operative to rotate relative to the friction rotational shaft, and the friction rotational shaft is configured to keep the hook module at a position forming an included angle with the bottom housing.

3. The cordless lamp of claim 2, wherein the hook module comprises:

a first plate member, provided with two of the mounting lugs that are oppositely disposed to each other, and an clearance notch;

a second plate member, wherein one end of the second plate member is connected to the first plate member, a projection of the second plate member in a vertical direction coincides with a projection of the first plate member in the vertical direction, and wherein the second plate member is provided with the nail hanging hole, which is arranged corresponding to the clearance notch.

4. The cordless lamp of claim 3, wherein the second plate member comprises:

a first inclined plate, wherein one end of the first inclined plate is connected to the first plate member through a rounded corner, and the first inclined plate is inclined toward the first plate member along a length of the first plate member; and a second inclined plate, wherein one end of the second inclined plate is connected to the first inclined plate, and the second inclined plate is inclined away from the first plate member in a direction away from the first inclined plate, and a connecting section of the second inclined plate and the first inclined plate abuts against the first plate member.

5. The cordless lamp of claim 3, wherein the nail hanging hole comprises a first elongated hole, a second elongated hole and a third elongated hole, wherein a width of the first elongated hole is greater than a width of the second elongated hole, and the width of the second elongated hole is greater than a width of the third elongated hole, and wherein the second elongated hole is connected to an end of the first elongated hole facing toward a joint of the first plate member and the second plate member, and the third elongated hole is connected to an end of the second elongated hole facing toward a joint of the first plate member and the second plate member.

6. The cordless lamp of claim 2, wherein the friction rotational shaft comprises:

a smooth shaft, wherein one end of the smooth shaft is provided with a connecting hole, and the smooth shaft is connected to the bottom housing through a connecting member inserted through the connecting hole;

a plurality of friction pieces, through which the smooth shaft is inserted; and a pressing cap, connected to another end of the smooth shaft, and configured for pressing the friction piece.

7. The cordless lamp of claim 1, wherein the cover housing comprises a main body and a lamp hood protruding from the main body, wherein the lamp hood comprises a light outbound surface, and wherein the light outbound surface is arranged at an included angle with a bottom wall of the cover housing.

8. The cordless lamp of claim 7, wherein the light-emitting module comprises: the reflecting cup, arranged in the lamp hood, wherein a top wall of the reflecting cup abuts the light outbound surface, and a bottom wall of the reflecting cup is provided with the matching hole.

9. The cordless lamp of claim 8, wherein the circuit board is provided with a mounting hole, and wherein the reflecting cup is provided with a mounting protrusion fitted with the mounting hole.

10. The cordless lamp of claim 1, wherein the first locking protrusion comprises a first inclined surface inclined toward an inner wall of the cover housing in a downward direction, and the snap ring comprises a second inclined surface inclined away from the bottom housing in an upward direction, and wherein the first inclined surface and the second inclined surface are correspondingly disposed.

11. The cordless lamp of claim 1, further comprising at least one selected from the group consisting of the following three features:

the first being that a sidewall of the second locking protrusion is provided with an inclined protrusion inclined away from the sidewall second locking protrusion in a direction from top to bottom;

the second being that a lower end of the second locking protrusion is provided with a wedge-shaped protrusion having a cross-sectional area that gradually increases in the direction from top to bottom; and the third being that the sidewall of the second locking protrusion is provided with a limiting step extending along a length of the second locking protrusion.

12. The cordless lamp of claim 1, wherein the second locking protrusion is an annular protrusion provided around the cover housing, and wherein the annular protrusion is provided with a plurality of first sawtooth grooves which are uniformly arranged on the annular protrusion, and wherein the clamping groove is an annular groove provided around the bottom housing, wherein the annular groove comprises an inner groove edge and an outer groove edge, and wherein the inner groove edge is provided with a plurality of second sawtooth grooves staggered with the first sawtooth grooves that are uniformly provided in the inner groove edge.

13. The cordless lamp of claim 1, wherein a front side and a rear side of the bottom housing are each provided with a first curved portion, a front side and a rear side of the cover housing are each provided with a second curved portion, wherein the second curved portion is arranged corresponding to the first curved portion to define a curved battery compartment, and a cross section of the curved battery compartment is a partial circle ranging from ½ to ¾ of one circle.

* * * * *